US010309092B2

(12) United States Patent
Kawazoe

(10) Patent No.: US 10,309,092 B2
(45) Date of Patent: Jun. 4, 2019

(54) HIGH-RISE ARCHITECTURAL STRUCTURE AND MAINTENANCE METHOD THEREFOR

(71) Applicant: TOTAL KANKYO CO LTD, Tokyo (JP)

(72) Inventor: Eiichi Kawazoe, Tokyo (JP)

(73) Assignee: TOTAL KANKYO CO. LTD., Tokyo (JP)

( * ) Notice: Subject to any disclaimer, the term of this patent is extended or adjusted under 35 U.S.C. 154(b) by 30 days.

(21) Appl. No.: 14/913,303

(22) PCT Filed: May 16, 2014

(86) PCT No.: PCT/JP2014/063108
§ 371 (c)(1),
(2) Date: Feb. 19, 2016

(87) PCT Pub. No.: WO2015/025565
PCT Pub. Date: Feb. 26, 2015

(65) Prior Publication Data

US 2016/0201313 A1 Jul. 14, 2016

(30) Foreign Application Priority Data

Aug. 19, 2013 (JP) ..... 2013-169735
Oct. 2, 2013 (JP) ..... 2013-207427

(51) Int. Cl.
*E02D 27/42* (2006.01)
*E04B 1/18* (2006.01)
*E04B 1/24* (2006.01)
*E04B 1/343* (2006.01)
(Continued)

(52) U.S. Cl.
CPC ..... *E04B 1/18* (2013.01); *E04B 1/24* (2013.01); *E04B 1/34315* (2013.01);
(Continued)

(58) Field of Classification Search
CPC .... E04B 1/18; E04B 1/34384; E04B 1/34315; E04B 1/24; E04G 5/046; E04G 1/38;
(Continued)

(56) References Cited

U.S. PATENT DOCUMENTS 802,252 A * 10/1905 Anderson ..... A62B 35/0062 182/3
2,122,908 A * 7/1938 Collins ..... B66B 9/00 182/142
(Continued)

FOREIGN PATENT DOCUMENTS

JP 2005-200917 * 7/2005

*Primary Examiner* — Basil S Katcheves
(74) *Attorney, Agent, or Firm* — Bednarek Legal, PLLC

(57) ABSTRACT

To ensure maintenance operations for an architectural structure using a mast climber without any limitation on the stability of a mast and locations where a mast can be erected. A side wall 101 of an architectural structure 100 is fitted with a fixing member 130 at a level higher than the ground 500. The fixing member 130 is fitted with fixture studs 132. A mast 200 is erected on the fixing member 130 with its lower end secured to the fixture studs 132. A climbing work platform 210 that travels up and down the mast 200 is fixed to the mast 200. A worker performs maintenance operations on the climbing work platform 210.

11 Claims, 20 Drawing Sheets

(51) Int. Cl.

| | |
|---|---|
| ***E04H 12/18*** | (2006.01) |
| ***E04H 12/20*** | (2006.01) |
| ***E04H 12/34*** | (2006.01) |
| ***E06C 9/00*** | (2006.01) |
| ***E04G 1/36*** | (2006.01) |
| ***E04G 1/20*** | (2006.01) |
| ***E04G 1/38*** | (2006.01) |
| ***E04G 5/04*** | (2006.01) |

(52) U.S. Cl.
CPC ..... *E04B 1/34384* (2013.01); *E04G 1/20* (2013.01); *E04G 1/362* (2013.01); *E04G 1/38* (2013.01); *E04G 5/046* (2013.01); *E04H 12/18* (2013.01); *E04H 12/20* (2013.01); *E04H 12/34* (2013.01); *E06C 9/00* (2013.01)

(58) Field of Classification Search
CPC ..... E04G 1/20; E04G 1/362; E04H 12/20; E04H 12/34; E04H 12/18; E06C 9/00
USPC ..... 52/169.13, 146
See application file for complete search history.

(56) References Cited

U.S. PATENT DOCUMENTS

| | | | | | |
|---|---|---|---|---|---|
| 5,056,619 | A * | 10/1991 | Darnell | A62B 1/06 | 182/191 |
| 5,265,696 | A * | 11/1993 | Casebolt | A62B 1/14 | 182/192 |
| 5,927,432 | A * | 7/1999 | Hershtik | B66B 9/00 | 182/82 |
| 6,311,800 | B1 * | 11/2001 | St-Germain | B66B 9/187 | 182/141 |
| 6,895,716 | B2 * | 5/2005 | Ellingson | A62B 1/20 | 182/73 |
| 8,695,759 | B1 * | 4/2014 | Michael | A62B 1/02 | 182/141 |
| 2006/0144639 | A1 * | 7/2006 | Iacoviello, Jr. | A62B 1/02 | 182/82 |
| 2014/0339383 | A1 * | 11/2014 | Lowe | F16M 11/28 | 248/161 |

* cited by examiner (A)

(B)

HIGH-RISE ARCHITECTURAL STRUCTURE AND MAINTENANCE METHOD THEREFOR

TECHNICAL FIELD

The present invention relates to maintenance methods for high-rise architectural structures. As used herein, the term "architectural structure" in "high-rise architectural structure" includes not only buildings, which are expected to accommodate people who enter them for their intended use, but also chimneys and bridges, which people are not expected to enter during normal service. In addition, as used herein, the term "high-rise" in "high-rise architectural structure" refers to a height at which technical difficulties would arise in the maintenance of the exterior walls of the architectural structure, at least 20 m or higher.

BACKGROUND ART

High-rise architectural structures are often particularly difficult to maintain when it comes to, for example, the inspection, cleaning, and re-application of paint, to their exterior walls and so on, though, which is not necessarily a problem inherent in high-rise architectural structures.

For architectural structures other than high rises, scaffolds such as Beatty frame scaffolds are erected along the exterior walls of the architectural structure with the scaffolding secured (if necessary) to an exterior wall of the architectural structure. A worker stands on it to perform maintenance operations. However, this approach cannot be used for taller architectural structures because the effort to assemble the scaffolding becomes excessive.

For these reasons, the maintenance of a high-rise architectural structure is usually performed by a worker in a gondola suspended from its topmost part. For example, maintenance of a building might be performed by a worker in a gondola suspended from winches installed on the rooftop of that building.

Although it is common to provide maintenance of an architectural structure by a worker in a gondola, as described above, some challenges remain: the number of places from which a gondola can be suspended is limited and the operations performed by a worker in a gondola tends to cause vibration, which can weaken his foothold and increase the level of danger.

Recently, mast climbers, which are also referred to as lift climbers, have been used in some sites for maintenance of architectural structures. They include one or more tall masts and a climbing work platform that can travel up and down along the mast(s). This allows a worker on the platform to perform operations including maintenance operations. Unlike Beatty frame scaffolds, which should normally be set up along the entire exterior wall of the architectural structure, mast climbers involve lower costs and less effort because they can be ready for use simply by erecting the required number of mast(s) to support the climbing work platform and attaching it to the mast(s). Foothold stability is better on the climbing work platform of such a mast climber than in a gondola suspended in the air; thus, from the safety standpoint, it is easier to guarantee the safety of a worker who performs maintenance operations for an architectural structure as compared to cases where a gondola is used.

SUMMARY OF THE INVENTION

Problems to be Solved by the Invention

To install a mast climber, the lower end of the mast is typically secured to a chassis. The chassis is designed to securely support the lower end of the mast after the mast is connected to the chassis. The chassis has a base and metal fixtures. The base is of sufficient size, shape, and weight to stably secure the mast when its lower end is securely fixed to the chassis, whereas the metal fixtures are used to fix the lower end of the mast.

The chassis of the mast climbers used in many countries other than Japan typically have wheels and are towed manually or by a power vehicle such as a motor vehicle to an appropriate position close to the architectural structure where the mast is to be erected. In contrast, Japanese regulations do not allow chassis to have wheels mainly for safety reasons. Accordingly, the chassis are typically loaded onto trucks or other vehicles and transported to the site, and then placed using heavy equipment or other means at appropriate position(s) close to the architectural structure where the mast(s) is/are to be erected. A mast climber may require several masts, and the aforementioned installation of the chassis may be costly and require a large labor force.

Mast climbers may be difficult or impossible to use for maintenance of architectural structures because of problems in placing the chassis.

For example, in the case of an apartment house, there may be obstacles that hinder the installation of the chassis including flower beds, bicycle parking areas, or monuments. Even though it is physically possible to erect a mast directly in front of the entrance of an apartment house, this may be practically undesirable. The number of the masts required to use a mast climber is not always one as described above, and the requirement of two or more masts occurs quire frequently. Accordingly, the possibility of occurrence of the aforementioned situations is high. In addition, these situations can occur for architectural structures other than apartment houses.

When such a situation occurs, the chassis is placed at a position that is different from the correct position to erect a mast at a position that is different from the correct position; alternatively, a temporary base may be constructed to straddle the obstacle and the chassis is placed on that base, as a last resort to use the mast climber. The former solution at least has the disadvantage that the climbing work platform is not in the most convenient position, whereas the latter entails additional labor and costs to construct the temporary base besides the large labor and cost required to place the chassis.

An object of the present invention is to reduce the labor and costs required to place the chassis for maintenance of architectural structures using a mast climber and to provide a technique that allows the chassis to be placed at a preferable position for maintenance of architectural structures.

Means to Solve the Problems

In order to solve the aforementioned problems, the present inventor proposes the following inventions. Hereinafter, the present invention is described separately as a first invention and a second invention for convenience.

The first invention proposed by the present inventor is a high-rise architectural structure comprising: at least one fixing member to which a fixture stud or studs for being connected to the lower end of at least one mast expected to be set along a side wall of the architectural structure can be attached, the lower end of the at least one mast being positioned above ground level, the fixing member(s) being configured to be fitted with the fixture stud(s) so that a required number of mast(s) can be erected at a suitable position or positions to provide maintenance of the architectural structure.

The architectural structure has the fixing member(s). Each fixing member is configured to be fitted with the fixture stud(s) that can be connected at a predetermined position to the lower end of a mast of a mast climber. The position where the fixture stud(s) is/are attached is chosen so that each mast can be erected at a suitable position to provide maintenance after the lower end of the mast is connected to the fixture stud(s). Two or more masts can be erected by providing the necessary number of fixture studs. The fixture stud(s) is/are positioned above ground level, so that the lower end of each mast can be supported above ground level. With the mast(s) supported some distance higher than the ground, it is possible to eliminate the problem owing to the presence of obstacles which is associated with the placement of the chassis to erect the mast(s) for the mast climber. Each mast can be erected at a correct position by providing the fixing member to which the fixture stud(s) can be attached at the proper position(s) to erect the mast.

A mast is expected to be erected or set along the side wall of an architectural structure. The term "along" when used in conjunction with the relative position of a mast and a side wall of the architectural structure does not necessarily mean that they are "in parallel," although a "parallel" relationship exists between them. Consider the example of a mast that is set vertical relative to, for example, the ground. When the upright mast is expected to lie, although not completely, "along" the side wall, the requirement that "the mast is expected to be set along the side wall of the architectural structure" is considered to be satisfied. Thus, even when the side surface of an architectural structure is slightly wavy in its vertical direction and the mast is vertical relative to the ground, the aforementioned requirement that "a mast is expected to be set along the side wall of an architectural structure" is considered to be satisfied. The same applies to the second invention.

The architectural structure according to the first invention may be a building for office use or an apartment building for residential use. It is noted that the architectural structure can be the one that is so-called a non-building structure, such as a chimney or a bridge, which people are not expected to enter during normal service. This also applies to the second invention.

The present applicant also proposes, as the invention to solve the problem associated with the present application, a maintenance method for the aforementioned high-rise architectural structures having the fixing member(s) to which the fixture stud(s) can be attached.

This method comprises the steps of: attaching the fixture stud(s) to the at least one fixing member at position(s) where the at least one mast is expected to be erected; setting the at least one mast along the side wall of the architectural structure by connecting the lower end of the at least one mast to the attached fixture stud(s); attaching a platform to the erected at least one mast, the platform being capable of moving up and down the at least one mast to which it is attached; and moving up and down the platform along the at least one mast while a worker on the platform is performing maintenance of the architectural structure.

The fixture studs of the first invention may be secured to the fixing member. The aforementioned architectural structure has no fixture stud before the time when the mast is to be erected (e.g., since the construction of the architectural structure was completed). The fixture stud(s) is/are attached to the fixing member and the lower end of the mast is connected to the fixture stud(s) when required to erect the mast. Alternatively, the fixture stud(s) may be attached to the fixing member before the time when the mast is to be erected (e.g., since the construction of the architectural structure was completed). In this case, the lower end of the mast can be secured simply by connecting the lower end of the mast to the fixture stud(s) that is/are already attached to the fixing member. The latter approach makes it easier to erect the mast, but it is necessary to choose the fixture stud(s) that is/are less likely to be damaged in the outside.

The present applicant also proposes, as the invention to solve the problem associated with the present application, a maintenance method for the aforementioned high-rise architectural structures having the fixing member(s) to which the fixture stud(s) is/are attached.

The method comprises the steps of: setting the at least one mast along the side wall of the architectural structure by connecting the lower end of the at least one mast to the fixture stud(s) secured to the at least one fixing member; attaching a platform to the erected at least one mast, the platform being capable of moving up and down the at least one mast to which it is attached; and moving up and down the platform along the at least one mast while a worker on the platform is performing maintenance of the architectural structure.

As described above, each fixture stud is connected to the lower end of the mast positioned above ground level. This means that each fixture stud is secured to the fixing member at a level higher than the ground.

The space around the architectural structure can be used effectively if there is sufficient space accessible for people beneath the fixing member(s). For example, each fixing member can be extended away from the side wall of the architectural structure and the fixture stud(s) can be attached to the upper surface thereof. In this case, each fixing member may be extended outward from the side wall of the architectural structure at a level two meters or more above the lower end of the side wall of the architectural structure. With a space of a height of about two meters beneath the fixing member(s), most people can freely move around therein. Preferably though, the fixing member(s) should be extended outward at a level 2.5-3 m above the lower end of the side wall of the architectural structure to avoid feelings of oppression and provide a sufficient space to allow most people to freely move around. When the fixing member(s) is/are placed in a higher position, the maintenance of the lower floors of the architectural structure may become harder, so that it is better to position the fixing member(s) at a level lower than 10 m. At heights lower than this, it is a simple matter to conduct maintenance of the architectural structure by a worker standing on a simple work platform established using a Beatty frame scaffold or a basket of a boom lift.

Each fixing member may have a plate-like shape.

The number of the fixing member(s) may be one or more. When two or more fixing members are used, they need not all be at the same height from the ground.

A single fixing member may be configured to be fitted with the fixture studs to connect two or more masts to the fixing member. Alternatively, a single fixing member may be configured to be fitted with the fixture stud(s) to connect only one mast to the fixing member. When the fixing member has fixture studs for the connection with two or more masts, these fixture studs can be located at the same or different levels from the ground.

A connector peg or pegs for being connected to the at least one mast can be provided on the side wall of the architectural structure of the first invention on a vertical line that is directly opposite to a line extending vertically from the point where the fixture stud is attached to the fixing member, and the at least one mast can be stably supported by the fixture stud(s) and the connector peg(s) once the at least one mast is connected to the fixture stud(s) at its/their lower end and to the connector peg(s) at appropriate position(s) along its/their length.

As described above, the lower end of the mast is secured by the fixture stud(s). Clearly, the mast will be more stable if it is secured at one or more points of an upper portion of the mast (the term "upper portion of the mast" as used herein refers to a portion of the mast except for its lower end). Under Japanese laws and regulations, the upper portion of the mast must also be secured. For this purpose, the mast should be connected to a side wall of the architectural structure using a specific type of fixture. Typical side walls have no suitable place to secure such a fixture. Accordingly, the portion of the mast except for its lower end is connected to the side wall of the architectural structure by, for example, driving a fixture into the side wall. This may cause damage to the architectural structure.

In contrast, the aforementioned architectural structure has been fitted with a connector peg or pegs that can be used to connect the lower end of the mast and the side wall since the construction of the architectural structure was completed. It is thus easy to connect the upper portion of the mast with them. In addition, each connector peg is provided on the side wall on a vertical line that is directly opposite to a line extending vertically from the point where the fixture stud is attached to the fixing member. As described above, the position of each fixture stud corresponds to the suitable position to secure the lower end of the mast that is erected at the preferable position to provide maintenance of the architectural structure using the mast climber. Accordingly, the point(s) on the side wall on the vertical line that is directly opposite to the mast correspond(s) the suitable positions to connect the side wall and the upper portion of the mast that is erected at the preferable position to provide maintenance of the architectural structure using the mast climber. Accordingly, with the architectural structure of the type described, it is easy to connect the lower end of the mast to the fixture stud(s) and the upper portion of the mast to the connector peg(s) at suitable position(s) along its length, which enables stable support of the mast by the fixture stud(s) and the connector peg(s).

The proximal end of each connector peg can be embedded in a side wall of a completed architectural structure. Retrofitting certain members might be contemplated to allow masts to be fixed to the side wall of the architectural structure (in fact, some techniques are practically used to connect a scaffold such as a Beatty frame scaffold to a side wall of an architectural structure using a first set of metal fixtures that are attached later to the architectural structure and a second set of metal fixtures each having one end to be secured to the first fixtures and the other end to be secured to the scaffold); however, it is difficult to ensure connections of sufficient strength between the members and the architectural structure. Furthermore, such members cannot always be attached to the desired positions on the side walls of the architectural structure. More than anything, the owner of an architectural structure usually dislikes possible damage that would be caused by such measures. If the proximal end of the connector peg is embedded in a completed architectural structure, the aforementioned disadvantage can be eliminated. The proximal end of the connector peg can be embedded in the side wall, or a pillar or a beam. This ensures stronger connections between the connector peg(s) and the side wall.

An anchor for preventing the connector peg(s) from escaping from the side wall can be provided on the proximal end of the connector peg(s) in order to ensure stronger connections between the connector peg(s) and the side wall of the architectural structure. The anchor can have any shape, as long as it prevents removal of the connector peg from the side wall. This ensures stronger connections of the connector pegs and the side wall.

As will be described below, the architectural structure can be a building. Some recent buildings may have side walls made up of prefabricated panels made in, for example, a factory. When a side wall of the building is made up of panels, proximal ends of at least some of the connector pegs can be embedded in the panel(s). When the architectural structure is a building and its side wall is made up of panels, the proximal ends of the all connector pegs can be embedded in either the panel(s) making up the outer surface of the side wall of the architectural structure or a pillar or a beam of the architectural structure. When the proximal end of the connector peg has an anchor, this further strengthens the connection between the side wall and the connector peg.

Embedding each connector peg in a side wall of an architectural structure can be performed during production of the side wall. For example, when a side wall is made of concrete, the proximal end of a connector peg can be embedded in the concrete when the concrete is being poured, so that it is already held by the side wall once the concrete has cured. In addition, when the architectural structure is a building and a side wall is made up of panels, the proximal end of a connector peg can be embedded in the panel during production of the panel. Known panels for exterior walls include autoclaved lightweight concrete (ALC) panels composed of lightweight concrete and prestressed concrete (PC) panels composed of high strength concrete. These panels typically have a thickness of several hundred millimeters. Accordingly, it is possible to ensure a sufficiently strong connection of a connector peg by embedding its proximal end in the concrete during pour. When the proximal end of the connector peg has an anchor, this further strengthens the connection between the panel and the connector peg and, in turn, the connection between the side wall of the architectural structure and the connector peg.

Each secure connection between a connector peg and a mast can be achieved either directly or indirectly via another means such as a different metal fixture. Basically, a secure connection between the mast and each connector peg must be achieved in a removable manner.

The connector pegs can be a nut. Each connector peg which is a nut can be embedded in the side wall at least at its proximal end, with an opening at one end of a threaded inner surface of the connector peg being exposed to the side wall. The other end of the nut may not have an opening (i.e., may be closed). A mast can be stably set without any restrictions on the position where it is set, simply by embedding the aforementioned required number of nuts at the aforementioned required positions on a side wall of an architectural structure.

The second invention is a high-rise architectural structure comprising: at least one pedestal member on which one or more chassis can be placed, the chassis having a fixture stud or studs for being connected to the lower end of at least one mast expected to be set along a side wall of the architectural structure, and a base to which the fixture stud(s) can be attached, the lower end of the at least one mast being positioned above ground level, the base being configured to support the at least one mast, the at least one pedestal member being configured to support the chassis thereon so that a required number of mast(s) can be erected at a suitable position or positions to provide maintenance of the architectural structure.

The architectural structure of the second invention has the pedestal member(s) in place of the fixing member(s) of the first invention. The chassis that can be secured to the lower end of the mast can be placed on each pedestal member. Each pedestal member is configured to allow the chassis to be placed at the position(s) where the mast should be erected to provide maintenance operations. If two or more masts are required, the pedestal member may be configured to support two or more chassis thereon and the masts can be erected on the respective chassis. The pedestal member(s) is/are positioned above ground level, so that the lower end of each mast can be supported above ground level. With the mast(s) supported some distance higher than the ground, it is possible to eliminate the problem owing to the presence of obstacles which is associated with the placement of the chassis to erect the mast(s) for the mast climber. Each mast can be erected at a correct position by providing the pedestal member on which the chassis can be placed at the proper position(s) to erect the mast.

The present applicant also proposes, as the invention to solve the problem associated with the present application, a maintenance method for the aforementioned high-rise architectural structures having the pedestal member(s) on which the chassis can be placed.

This method comprises the steps of: placing the one or more chassis on the pedestal member(s) at position(s) where the at least one mast is expected to be erected; setting the at least one mast along the side wall of the architectural structure by connecting the lower end of the at least one mast to the fixture stud(s) of the placed chassis; attaching a platform to the erected at least one mast, the platform being capable of moving up and down the at least one mast to which it is attached; and moving up and down the platform along the at least one mast while a worker on the platform is performing maintenance of the architectural structure.

As described above, the lower end of the mast is secured to the chassis placed on the pedestal member at a level higher than the ground.

A sufficient space in which people can freely move around can be provided beneath the pedestal member(s), as in the case of the fixing member(s) of the first invention. The pedestal member(s) can be configured to support the chassis placed on the upper surface thereof and can be extended from the side wall of the architectural structure, as in the case of the fixing member(s). Preferably though, the pedestal member(s) should be extended outward at a level 2.5-3 m above the lower end of the side wall of the architectural structure to avoid feelings of oppression and provide a sufficient space to allow most people to freely move around. The lower end of the mast placed on the pedestal member is preferably located at a level lower than 10 m in consideration of the fact that the maintenance from the climbing work platform attached to the mast(s) may become harder.

Each pedestal member may have a plate-like shape.

The number of the pedestal member(s) may be one or more. When two or more pedestal members are used, they need not all be at the same height from the ground.

A single pedestal member may be configured to receive the two or more chassis to be connected to the two or more masts, respectively. Alternatively, a single pedestal member may be configured to receive one chassis to be connected to only one mast.

A connector peg or pegs for being connected to the at least one mast can be provided on the side wall of the architectural structure of the second invention on a vertical line that is directly opposite to a line extending vertically from the point where the chassis is to be placed on the pedestal member, and the at least one mast can be stably supported by the fixture stud(s) and the connector peg(s) once the at least one mast is connected to the fixture stud(s) of the chassis at its/their lower end and to the connector peg(s) at appropriate position(s) along its/their length.

With the architectural structure of the type described, it is easy to connect the lower end of the mast to the fixture stud(s) and the upper portion of the mast to the connector peg(s) at suitable position(s) along its length, which enables stable support of the mast by the fixture stud(s) and the connector peg(s) as in the case of the first invention.

The connector peg provided on the side wall of the architectural structure of the first and second inventions can have the following variations.

For example, the connector pegs have any shape as long as they can be connected to the mast. Each secure connection between a connector peg and a mast can be achieved either directly or indirectly via another means such as a different metal fixture. Basically, a secure connection between the mast and each connector peg must be achieved in a removable manner.

The connector pegs can be a nut. Each connector peg which is a nut can be embedded in the side wall, with an opening at one end of a threaded inner surface of the connector peg being exposed to the side wall. A mast can be stably set without any restrictions on the position where it is set, simply by embedding the aforementioned required number of nuts at the aforementioned required positions on a side wall of an architectural structure.

Each connector peg can be concealed with a cover that prevents the connector peg from being exposed, the cover being designed so that it can be removed when the connector peg is connected to the mast.

The connector pegs provided on a side wall of an architectural structure can spoil the esthetic appearance of the architectural structure. Furthermore, an object that is thrown into the air for some reason could be caught on a connector peg located in a high position. The aforementioned cover would prevent such situations. For example, by choosing a cover with an appearance that is compatible with the exterior wall of the architectural structure, it is possible to reduce the possibility of spoiling the appearance of the architectural structure. Such a cover can have either the function of keeping the esthetic appearance of the architectural structure or the function of reducing the possibility of something being caught on a connector peg.

The cover may be capable of being attached to and removed from the side wall. Such cover can be used repeatedly by removing it when a mast and a connector peg are connected and attaching the cover again once the mast and the connector peg are disconnected.

The cover or covers can be configured such that the connector peg or pegs inside the cover is/are exposed when the cover is broken. For example, clayey materials such as clay, mortar-like materials such as mortar, or resins such as urethane foam, urethane, and polystyrene foam can be used as a cover material. When one of them is used as a cover material, it is possible to reduce the influence of moisture on the connector peg by preventing rainwater infiltration.

As described above, a connector peg or pegs is/are positioned on a side wall of a high-rise architectural structure so as to allow stable support of a mast by the connector peg(s) once the mast is connected to the connector peg(s), the number of the connector pegs being sufficient to stably support the mast by the connector peg(s) once the mast is connected to the connector peg(s). The number of the connector pegs may be one or more, as long as the purpose can be achieved.

For example, at least two connector pegs can be provided along at least one vertical line on an outer surface of the side wall. Such arrangements of the connector pegs allow the upper portion of the mast to be connected at two different positions, in addition to the lower end of the mast, which is useful for increasing the stability of the mast.

The connector pegs are provided on a side wall. The point where each connector peg is attached may be either on the exterior surface of the side wall or within the side wall. Since it is necessary that each connector peg can be secured to a mast, at least a portion of the connector peg is exposed to the outside when the aforementioned cover or another cover described below is not used.

At least one of the connector pegs can be provided inside a recess formed in an outer surface of the side wall so that the at least one connector peg is not exposed to the outer surface of the side wall that is a generally flat surface of the side wall. As described above, a cover can be used as a feature to provide the function of keeping the esthetic appearance of an architectural structure or the function of reducing the possibility of something being caught on a connector peg. The recess having the connector peg inside would provide similar functions to those of a cover. It is of course expected that all connector pegs would be inside a recess or recesses.

When the architectural structure is a building, a gap between panels that make up an outer surface of the side wall of the building can be used as the recess. More specifically, when at least one of the connector pegs is provided inside a recess formed in an outer surface of the side wall so that the at least one connector peg is not exposed to a plane where the outer surface of the side wall is absent, the plane being generally flush with the outer surface of the side wall, the recess can be a gap between panels making up the outer surface of the side wall of the building.

In any of the aforementioned cases, a cover or covers that conceal(s) the connector peg or pegs, respectively, can be provided over the recess. The configuration and the function of the cover are as described above.

The cover may be a plate-like member that conceals an opening of the recess. The plate-like member may be capable of being attached to and removed from the opening of the recess. This allows repeated use of the cover. In order to make an appearance of the cover compatible with the exterior wall of the architectural structure, the outer surface of the cover, which is a plate-like member, can be provided with a material (such as a tile) used to finish the surface of the side wall of the architectural structure.

The cover can be filled in the recess. The cover in this case can be configured such that the connector peg(s) inside the cover is/are exposed when the cover is broken. For example, clayey materials such as clay, mortar-like materials such as mortar, or resins such as urethane foam, urethane, and polystyrene foam can be filled in the recess as the cover.

In such a case, the recess can have a shape and a size sufficient to provide a connection between a connector peg and a joint member that ties the connector peg and the mast, the connection being achieved in the recess. The connector peg inside the recess would be connected to one end of the joint member, and the mast would be connected to the other end. Consequently, the connector peg and the mast would be securely connected to each other. By using the recess having a shape and a size sufficient to provide a connection between a connector peg and a joint member that ties the connector peg and the mast in the recess (i.e., a shape and a size with a sufficient space for such a connection), it is possible not only to connect the connector peg and the joint member but also to use the connector peg in the recess again once the connector peg and the joint member are disconnected to release the connection between the mast and the connector peg. A cover can be provided again over the recess for such repeated use.

EMBODIMENTS FOR CARRYING OUT THE INVENTION

Figure 1:
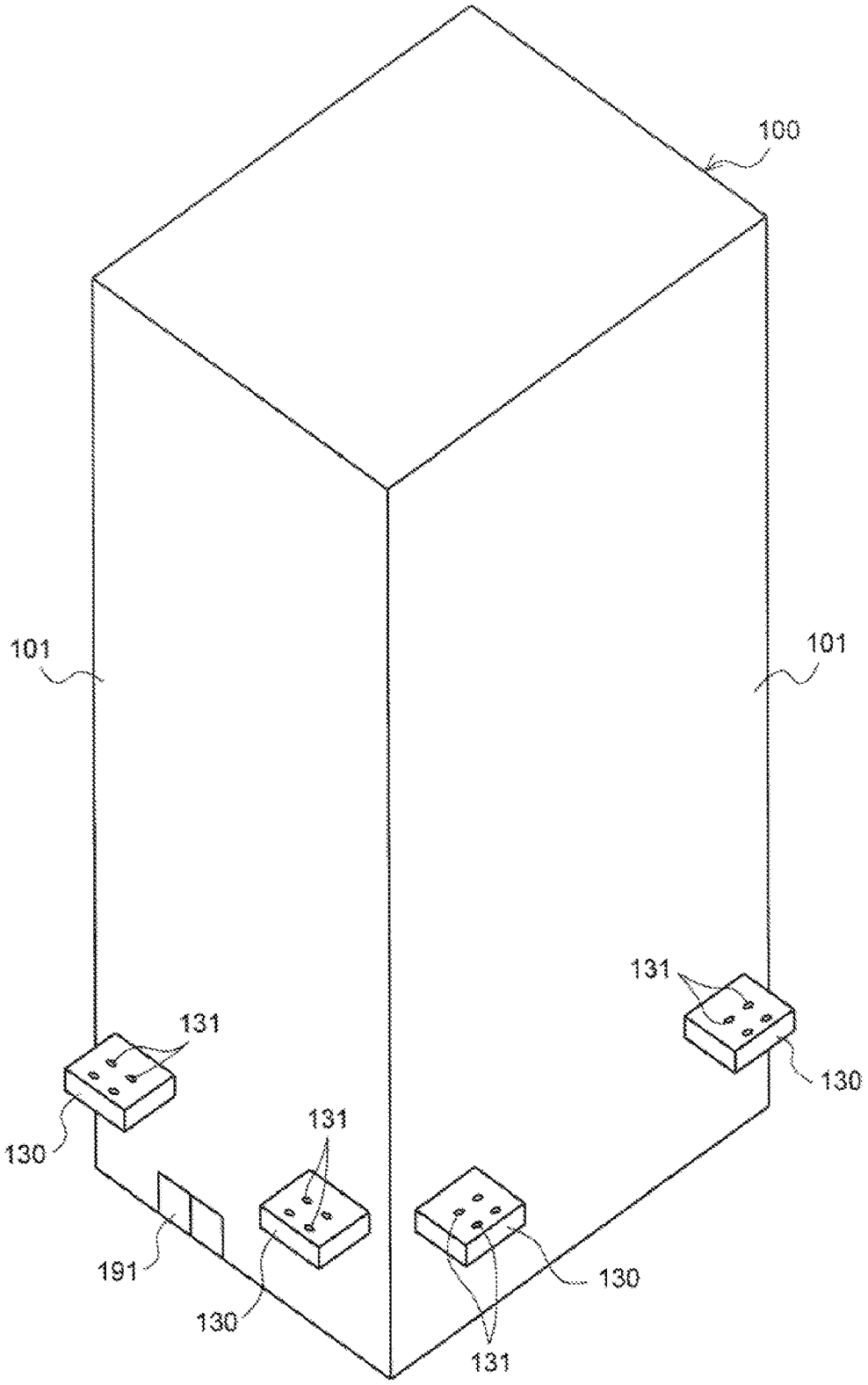
FIG. 1 is a perspective view schematically showing an entire architectural structure according to a first embodiment of the present invention.

First through third preferred embodiments of the present invention are described in detail below with reference to the drawings. It is noted that identical elements in these embodiments and modified versions thereof are designated with the same reference numerals, and redundant description thereof will be omitted, as a case may be.

First Embodiment

FIG. 1 shows an architectural structure 100 according to a first embodiment.

The architectural structure 100 is a building, but not limited thereto. The building, which is the architectural structure 100, may be, for example, an office building or an apartment house. The architectural structure 100 is free-standing on the ground 500. The configuration of the architectural structure 100 is quite typical except for a fixing member and a connector peg described below. Side walls 101 define the four faces of the architectural structure 100 in FIG. 1 and an entrance 191 is provided in one of the side walls 101. While neither window nor other object is illustrated in the architectural structure 100 in FIG. 1, it should be noted that the architectural structure 100 has components to fulfill the functions required for ordinary architectural structures or ordinary buildings.

The architectural structure 100 is high rise. The architectural structure 100 has a height of 20 m or higher. This is the height that tends to cause troubles in its maintenance. The height of the architectural structure 100 may be several hundred meters or higher. Maintenance of the architectural structure 100 will be performed using a mast climber as described below.

Figure 2:
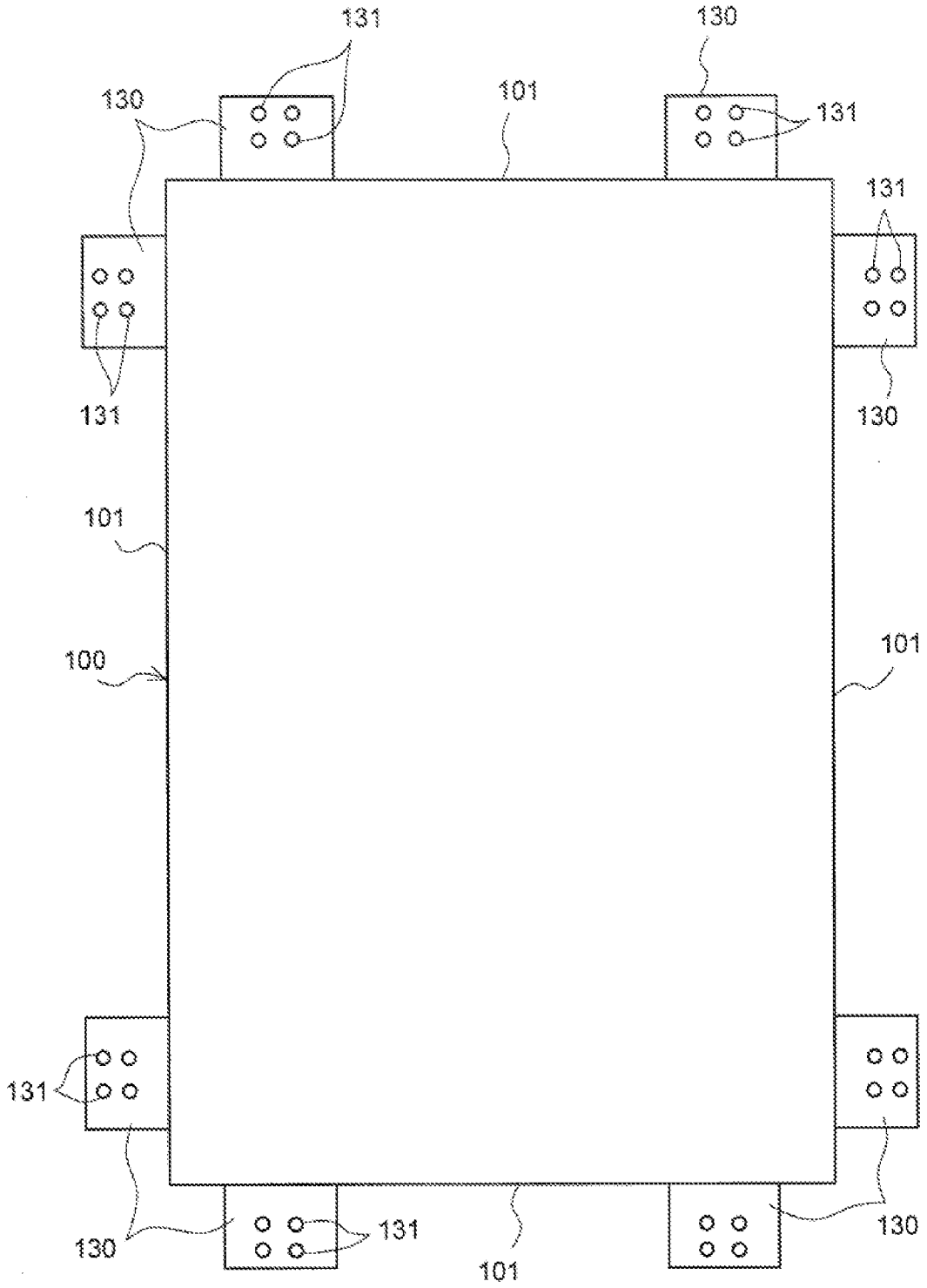
FIG. 2 is a plan view showing an exemplified arrangement of fixing members provided on a side wall of the architectural structure shown in FIG. 1.

Each side wall 101 of the architectural structure 100 is fitted with two fixing members 130 (FIGS. 1 and 2). The fixing members 130 can be connected to the lower end of a mast which is described below for securely supporting the mast. As will be described below, the mast forms a part of a mast climber. Each fixing member 130 in this embodiment is connected to the lower end of one mast to support that mast, which is not necessarily so. The fixing member 130 has a sufficient strength to support the mast, and is secured to the side wall 101 strongly enough to do so.

The fixing member 130 is located at a position above the ground 500. The fixing member 130 has, but not limited to, a plate-like shape and has, but not limited to, a rectangular shape when seen from the above. The fixing member 130 may be decorated in a style that matches the esthetic appearance of the architectural structure 100. The fixing member 130 is positioned so that the distance from the ground to the lower surface of the fixing member 130 is 2 m or more. In this embodiment, the distance to the lower surface is, but not limited to, 3 m. This allows people to freely move around in the space beneath the fixing member 130 to make a flower bed or a bicycle parking area without any trouble.

The upper surface of the fixing member 130 has, but not limited to, holes 131 that are used to connect the fixing member 130 with fixture studs as described below. Each fixing member 130 has four holes 131 in this embodiment, but not limited thereto. The four holes 131 function as a set to support a single mast. The upper surface of the fixing member 130 is positioned no higher than 10 m, but not limited thereto. The fixture studs in this embodiment are thus attached at a level lower than 10 m from the ground.

The fixture studs are connected to their corresponding holes 131 by inserting one end of a bolt as described below (i.e., the fixture stud) into the hole 131, leaving the other end of the bolt exposed. This portion of the bolt exposed from the hole 131 is used for securing the mast. The inner surface of the hole 131 in this embodiment is threaded, and the bolt and hole 131 are securely connected to each other by screwing the lower end of the bolt into the threading in the hole 131, but not limited thereto. The thread on the inner surface of the hole 131 can be supplied by inserting a nut into the hole 131. The nut has, for example, an anchor to prevent the nut from escaping from the hole 131. The nut can be embedded in the fixing member 130 when the concrete is being poured to produce the fixing member 130.

For the easier understanding, the fixing members 130 and the holes 131 in FIG. 1 are shown at a larger scale.

As described above, each side wall 101 of the architectural structure 100 has two fixing members 130. The fixing members 130 are positioned at or near the right and left ends of the side wall 101. Two masts as described below that are erected on the corresponding fixing members 130 on the same side wall 101 support a single climbing work platform arranged along the side wall 101 described below, at or near the ends of the platform.

The fixture studs (or the holes 131) of the fixing member 130 are placed at the optimal positions for positioning the lower end of the mast during maintenance operations. In other words, when the lower end of the mast is connected to the fixture studs that are partially embedded in the holes 131 in the fixing member 130, the mast is automatically in a place suitable for supporting the climbing work platform used for maintenance.

It should be noted that all holes 131 in all fixing members 130 may be fitted with the fixture studs before the mast is erected (e.g., since the construction of the architectural structure 100 was completed).

Figure 3:
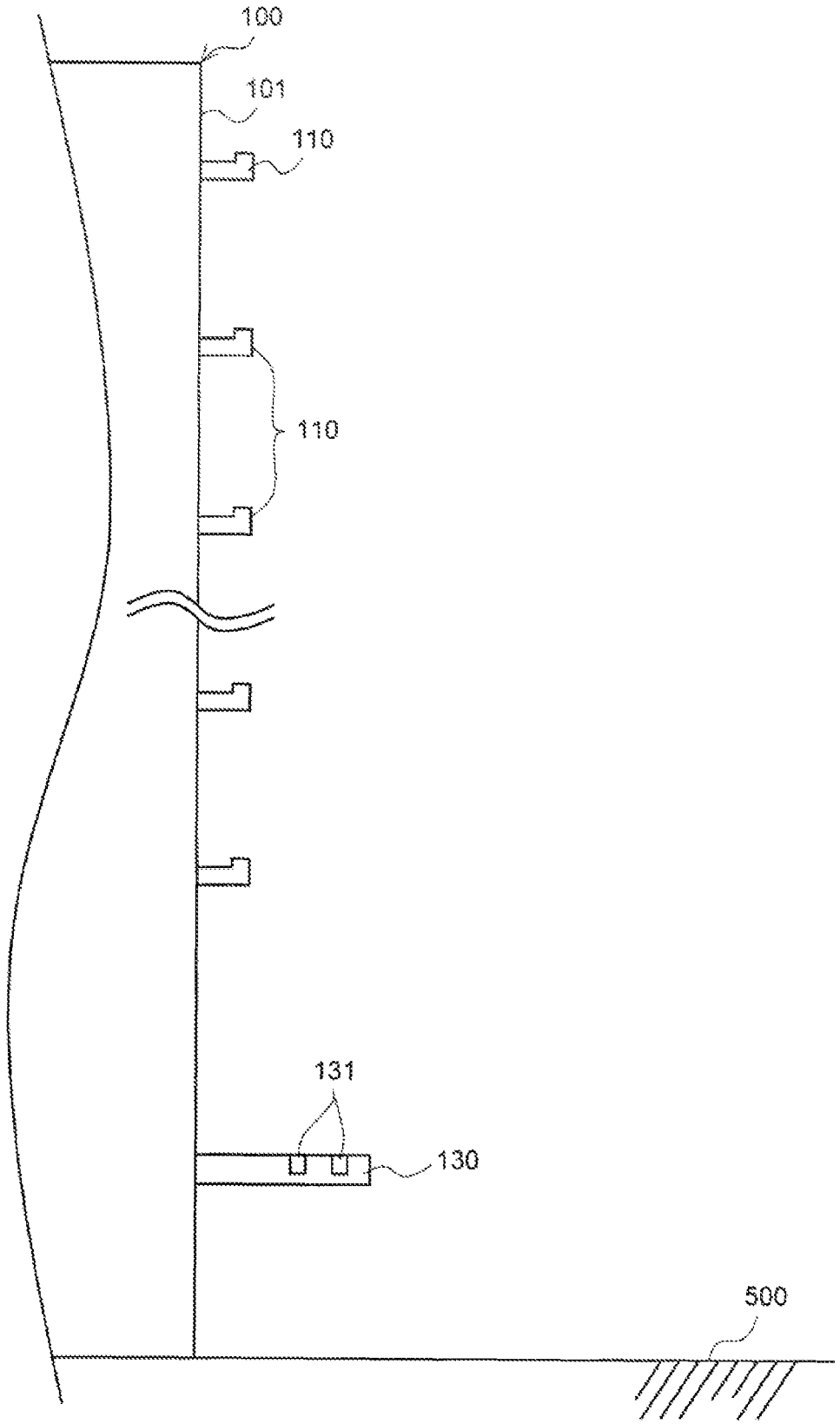
FIG. 3 is a side view showing an exemplified arrangement of connector pegs provided on or in a side wall of the architectural structure shown in FIG. 1.

While not illustrated in FIG. 1, connector pegs 110 are attached to the side wall(s) 101 at appropriate positions, as shown in FIG. 3.

These connector pegs 110 are made of metal. As described below, the connector pegs 110 can be connected to an upper portion of the mast (i.e., a portion of the mast except for its lower end). Each connector peg 110 is strong enough to support the mast in a stable manner when it is connected to an upper portion of the mast. For the easier understanding, the connector pegs 110 in FIG. 1 are shown at a larger scale than the other components.

The connector pegs 110 attached to the side wall 101 of the architectural structure 100 are aligned on the side wall 101 on a vertical line that is directly opposite to a line extending vertically from the point where the hole 131 in the fixing member 130 is present. The connector pegs 110 run in two vertical lines near the two ends of the side wall 101, each with two or more connector pegs 110. The number of the connector pegs 110 in each vertical line may be one, but is two or more in this embodiment. When each vertical line includes two or more connector pegs 110, the adjacent connector pegs may be aligned at equal or different intervals. Since the connector pegs 110 are aligned on the side wall 101 on a vertical line that is directly opposite to a line extending vertically from the point where the hole 131 in the fixing member 130 is present, the connector pegs 110 on the side wall 101 will face a mast erected on the fixing member 130, with the connector pegs 110 aligned vertically opposite to the mast. It is easy to connect the connector pegs 110 and the mast in a manner described below because the connector pegs 110 and the mast erected along the side wall 101 are positioned close to each other.

If it is clear before the construction of an architectural structure 100 that one or more of the side walls 101 of that architectural structure 100 do not require the use of a mast climber for maintenance, it is not necessary to provide a fixing member 130 and/or a connector peg 110 as described above on that wall.

The connector pegs 110 may be secured to the side wall 101 by any one of a variety of means as long as a sufficient strength can be provided. For example, when the connector peg 110 has a plate-shaped base and an appropriate number of screw holes are formed in the base, the connector peg 110 can be secured to the side wall 101 by screws passing through the screw holes into the side wall 101.

Figure 20:
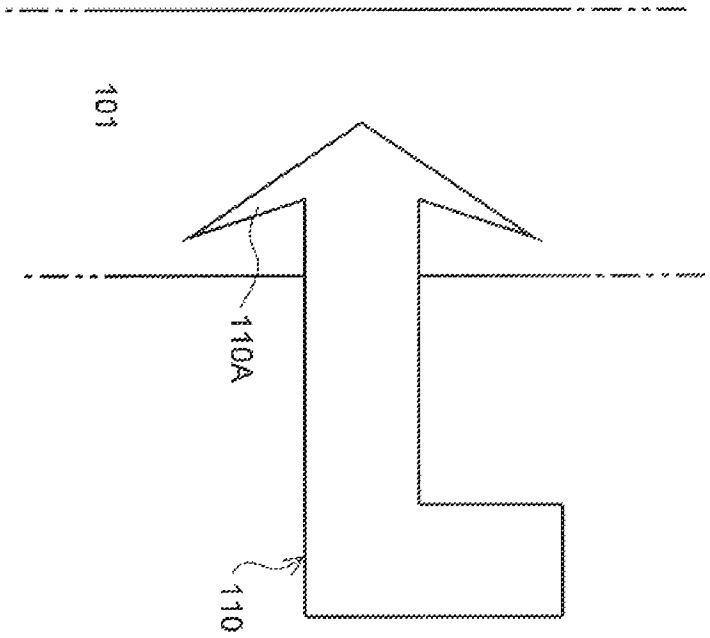
FIG. 20 is a cross-sectional view showing how connector pegs are attached to a side wall of the architectural structure shown in FIG. 1.

Each connector peg 110 in this embodiment is attached to, but not limited to, the side wall 101 as shown in FIG. 20. An anchor 110A is provided at the proximal end of the connector peg 110.

The anchor 110A of the connector peg 110 is provided during the production of the side wall 101. For example, before pouring the concrete to produce the side wall 101, the anchor 110A is placed in a space where the side wall is to be provided. With this state, the concrete is poured and cured. The anchor 110A of the connector peg 110 is thus embedded in the side wall 101. The anchor 110A has a shape like an open umbrella. This shape serves to prevent the anchor 110A from being fallen off the side wall 101. With the anchor 110A, the connector peg 110 is secured to the side wall 101. The anchor 110A does not necessarily have a shape like an open umbrella as illustrated and it may have any shape as long as slippage of the anchor 110A from the side walls 101 can be prevented. The anchor 110A may have any known shape. The anchor 110A is embedded in the side wall 101 or a pillar or a beam which is not shown of the architectural structure 100.

When the architectural structure 100 is a building, the side wall 101 may be made up of sets of panels. Each panel may be, for example, an ALC panel or a PC panel. The panel has, for example, a rectangular plate-like shape. Typically, adjacent panels have the same vertical and lateral dimensions. The panels are arranged in rows and columns to make up the side wall 101. The anchor 110A of the connector peg 110 may be embedded in the panel during the production of the panel. When the panel is made of concrete, then the anchor 110A may be embedded in the panel during production of the panel in a manner similar to the one described in conjunction with the case where the anchor 110A is embedded in the side wall 101 during production of the side wall 101. The panel has a thickness providing sufficient strength of the panel itself and of the connection between the panel and the anchor 110A even after such embedding of the anchor 110A. The thickness is, for example, around 300 mm. When the side wall 101 of the architectural structure 100 is made up of sets of panels, it is not necessary that all panels have the connector peg 110 attached thereto. Alternatively, single panel may have two or more connector pegs 110. Panels are usually fabricated in a factory, rather than on the construction site of the architectural structure 100. Accordingly, in fabricating the panels in the factory, they may be designed in such a manner that the connector pegs 110 will finally be placed at necessary positions once the side wall 101 of the architectural structure 100 is made up by arranging the panels.

Next, a maintenance method for the architectural structure 100 having the connector pegs 110 is described.

For maintenance operations, a mast climber is used. Mast climbers are known in the art and therefore detailed description of them will be omitted because no further description should be required for those skilled in the art. Mast climbers comprise single or twin masts and a climbing work platform that can freely travel up and down along the mast(s). The climbing work platform includes a drive unit. The drive unit is for generating power to move the climbing work platform up and down the mast(s) as well as for holding it on the mast at any appropriate height.

To provide maintenance, masts are erected at suitable positions to support a climbing work platform so that the latter is positioned at a desired position for maintenance operations.

Figure 4:
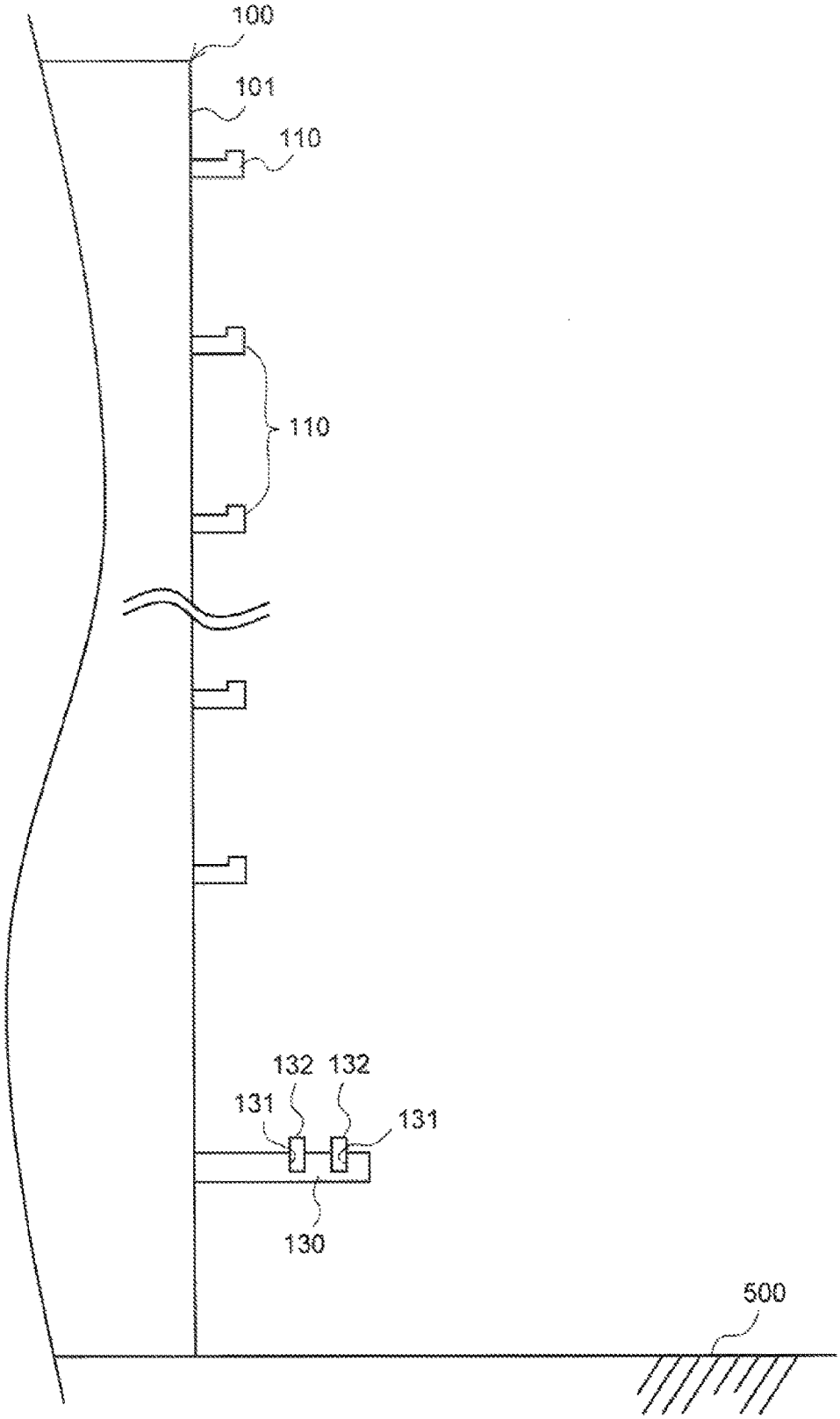
FIG. 4 is a side view schematically showing fixture studs fitted in holes in a fixing member for provide maintenance of the architectural structure shown in FIG. 1.

For this, fixture studs 132 are inserted into and secured to the holes 131 in the fixing member 130 on which the mast is to be erected (FIG. 4). As described above, the fixture stud 132 in this embodiment is a bolt. The fixture stud 132 is securely fixed to the corresponding hole 131 by mutual threaded engagement between them. It should be noted that if the architectural structure 100 already has the fixture studs 132 fixed to the holes 131 in all fixing members 130, this step of fixing the fixture studs 132 to the holes 131 can be omitted.

Figure 5:
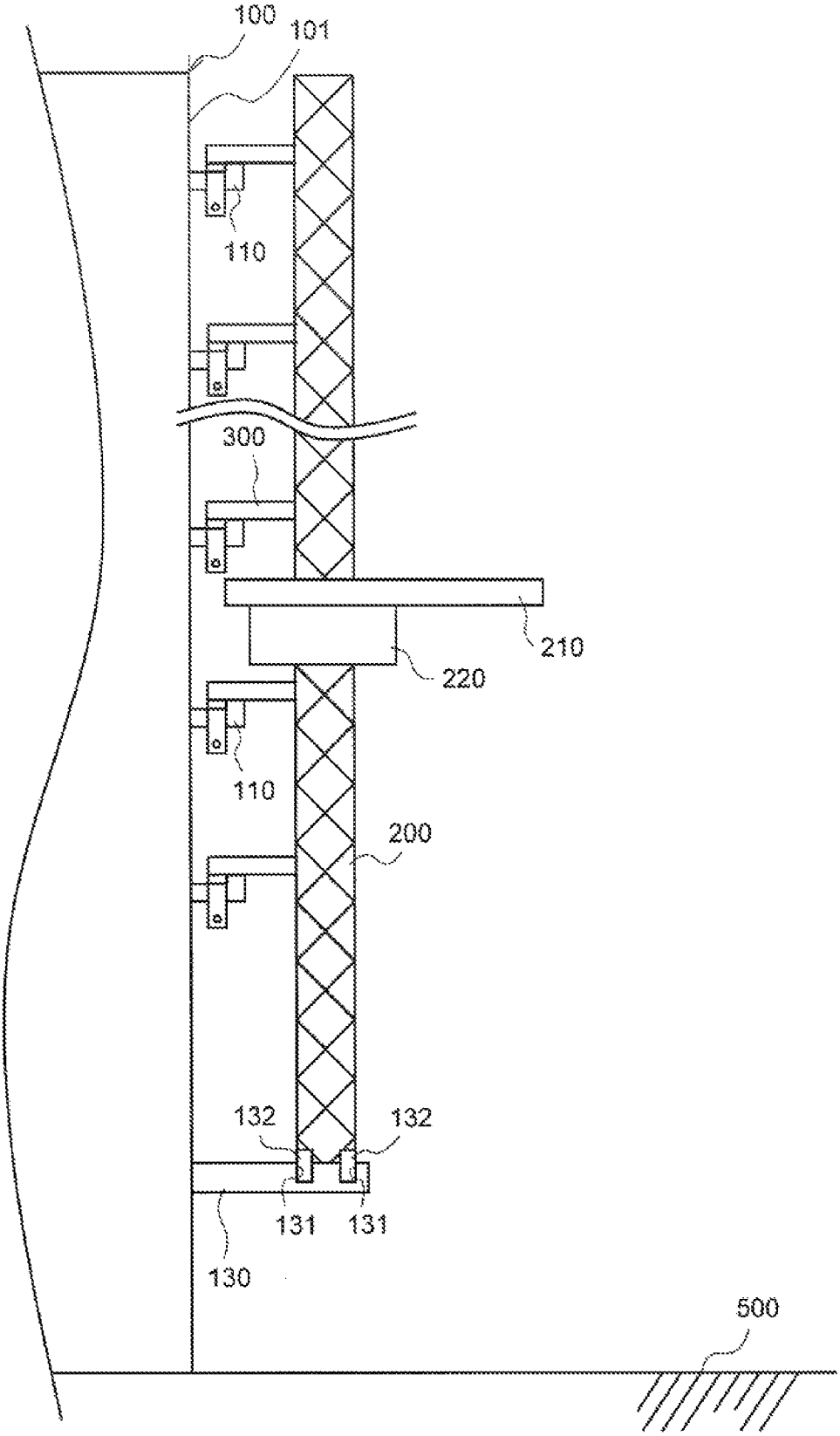
FIG. 5 is a side view schematically showing a state where the architectural structure shown in FIG. 1 is under maintenance.

Next, a mast 200 is erected on the fixing member 130 to which the fixture studs 132 are secured (FIG. 5). Each mast 200 is typically made of mast modules of an appropriate length. The mast modules are stacked on top of each other to extend the mast upward to the desired height.

First, the lower end of the mast 200 (i.e., the lower end of the lowest mast module) is secured to the aforementioned fixture studs 132. This can be done using an appropriate method known or well-known to those skilled in the art. A method similar to the one used for connecting the mast 200 to the fixture studs of a conventional chassis can be used.

Next, a climbing work platform 210 is attached to the mast 200 (more precisely, the mast module secured to the fixing member 130). As shown in FIG. 5, the climbing work platform 210 has the aforementioned drive unit 220. The climbing work platform 210 is usually provided with components such as surrounding guardrail(s) to guarantee the safety of a worker on the climbing work platform 210, but they are not shown nor described herein.

Next, the mast modules to be stacked are mounted on the climbing work platform 210, and the climbing work platform 210 is moved toward the top of the mast module already secured to the fixture stud 132. One mast module on the climbing work platform 210 is then connected to the top of the mast module below, and the process is repeated to extend the mast 200 upwards.

When there is a connector peg 110 on the side wall 101 opposite to the mast 200 and the mast 200 should be connected to the connector peg 110 to ensure the stability of the mast 200, the connector peg 110 and the upper portion of the mast 200 are connected. The mast 200 can be connected to the connector pegs 110 via respective joint members 300.

Figure 6:
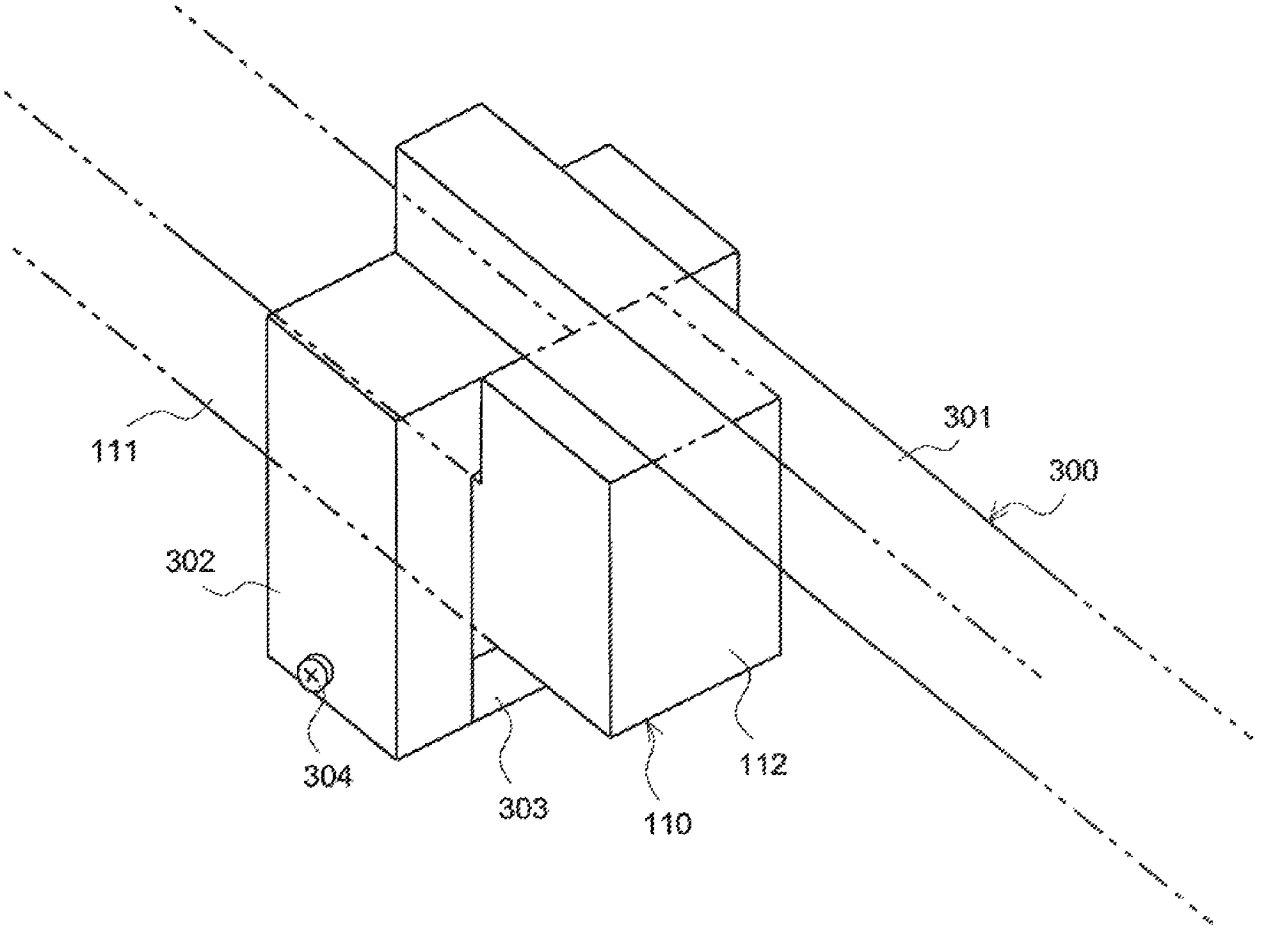
FIG. 6 is a perspective view showing connection between a connector peg and a joint member shown in FIG. 5.

The connector peg 110, a detailed structure of the joint member 300, and how they are joined to each other are described in conjunction with a perspective view in FIG. 6. The joint member 300 in this embodiment is made of a metal. The only requirement for the connector peg 110 and the joint member 300 is that they are capable of being connected to each other in a removable manner. In other words, the configuration of the connector peg 110 and the joint member 300 is merely one of possible configurations.

The connector peg 110 has a connector shank portion 111 extending at right angles from the side wall 101 and a connector hook portion 112 formed by bending, but not limited to, the connector shank portion 111 upward. The connector shank portion 111 is secured to the side wall 101 at its proximal end (back left in FIG. 6) by an appropriate means. For example, the proximal end of the connector shank portion 111 is secured to the side wall 101 by screwing, with the side wall 101, a bolt passing through a bore formed in a plate-shaped base provided at the proximal end of the connector shank portion 111; or securing fixing, in the side wall 101, an anchor provided on the proximal end of the connector shank portion 111, the anchor having a profile that prevents it from dropping once it is embedded in the side wall 101.

The joint member 300 includes a bar-shaped joint shank portion 301. The joint shank portion 301 can be connected to the mast 200 at its proximal end (front right in FIG. 6) by an appropriate means which is not illustrated nor described in detail. A catcher portion 302 is provided at the distal end of the joint shank portion 301. The catcher portion 302 is for securely fixing the joint shank portion 301 and the connector peg 110. The catcher portion 302 has a rectangular U-shape opened downward. Screw bores which are not shown are formed in the catcher portion 302 at both ends thereof. A cover piece 303, which is a plate-like member, can be attached to the lower end of the catcher portion 302. The cover piece 303 is for closing the lower opening in the catcher portion 302. Bores which are not shown are formed in the catcher portion 302 at both ends thereof. Screw holes which are also not shown are formed in the cover piece 303 at both ends thereof, at positions corresponding to the bores. The cover piece 303 is tightly fixed to the catcher portion 302 by screwing bolts 304 passing through the two bores formed at the ends of the catcher portion 302 with the screw holes formed in the cover piece 303 at both ends thereof. In this state, a rectangular bore is formed which is defined by the cover piece 303 on the lower side and the inner surfaces of the catcher portion 302 on the upper, right, and left sides of the bore. The cross-sectional shape and the size of the rectangular bore correspond to those of the connector shank portion 111 of the connector peg 110. In other words, once the cover piece 303 is securely fixed to the catcher portion 302 with two arms of the catcher portion 302 extending on either side of the connector shank portion 111 of the connector peg 110, the connector shank portion 111 does not escape from the aforementioned bore defined by the catcher portion 302 and the cover piece 303 because the free end of the connector shank portion 111 is thicker by the presence of the connector hook portion 112.

By mutual engagement between (the edge of) the aforementioned rectangular bore and the connector hook portion 112, the connector peg 110 and the joint member 300 can tightly be fixed to each other.

It is noted that either of the connection between the mast 200 and the joint member 300 or the connection between the joint member 300 and the connector peg 110 may be made first.

By repeating the above process, the mast 200 is erected generally vertically in this embodiment along the side wall 101 as shown in FIG. 5.

Figure 7:
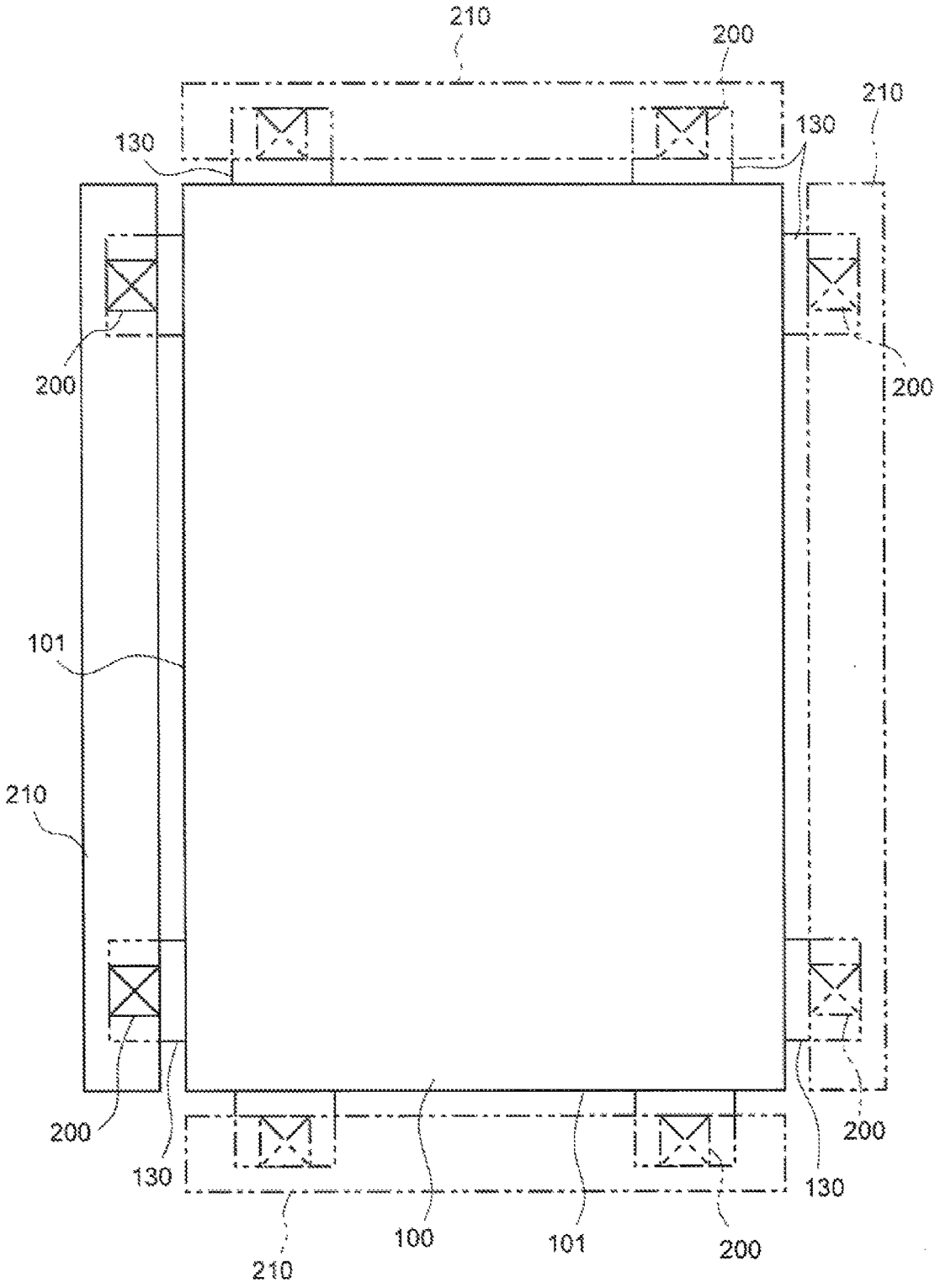
FIG. 7 is a plan view schematically showing a state where the architectural structure shown in FIG. 1 is under maintenance.

In this embodiment, as shown in FIG. 7, the masts 200 are erected on the fixing members 130 connected to the same side wall 101 (e.g., the left surface in FIG. 7) and the climbing work platform 210 is supported by these two masts 200. This shows a state where maintenance is being conducted on the left side wall 101 in FIG. 7.

Maintenance can be conducted on other side walls 101 (which are depicted by a long dashed double-short dashed line in FIG. 7) facing to the climbing work platform 210 by erecting the masts 200 on the fixing members 130 on the side wall 101 and passing the climbing work platform 210 between the masts 200, as in the case of the left side wall 101 in FIG. 7.

One can determine which side wall 101 is subjected to maintenance as he or she likes, and it is possible that two or more side walls 101 are subjected to maintenance at the same time.

A worker stands on the climbing work platform 210 fixed to the mast 200, moves the platform up and down, and stops the platform at a desired height. The worker can safely perform maintenance of the architectural structure 100.

After completion of maintenance, the mast 200 is disassembled back into mast modules by reversing the procedure described above. Finally, the mast modules and the climbing work platform 210 are taken out.

<Modified Version 1>

Next, modified versions of the first embodiment are described.

The connector pegs 110 in the first embodiment are secured to the side wall 101 and exposed outside. However, it is often better that the connector pegs 110 are not exposed in terms of the esthetic features of the architectural structure 100. In addition, problems that something is caught on the connector peg(s) 110 can be reduced.

Figure 8:
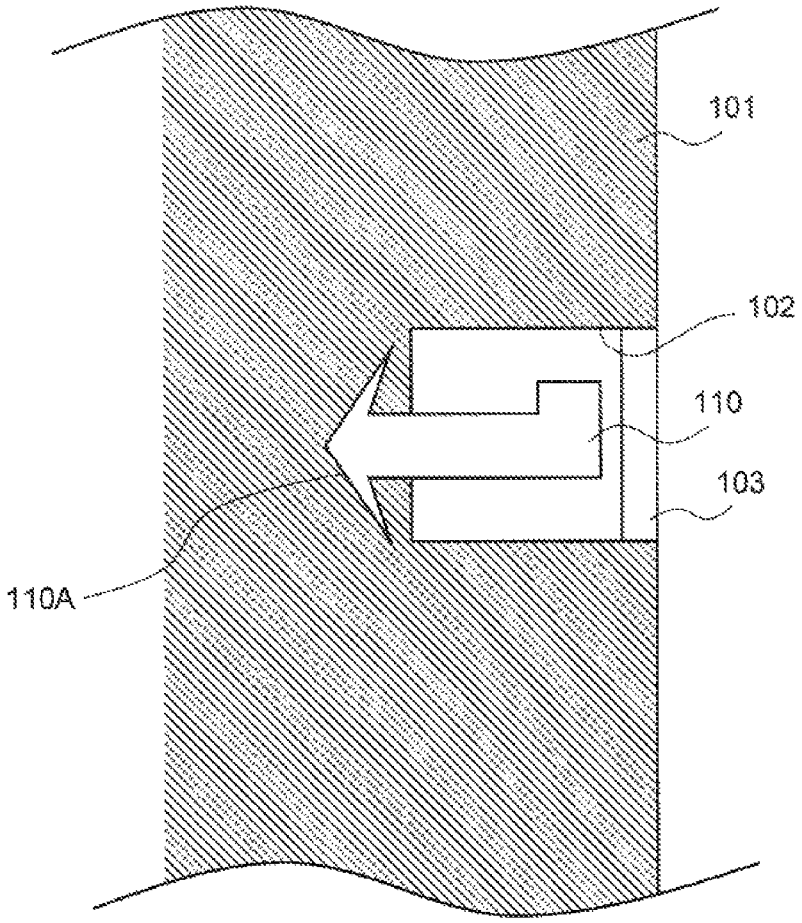
FIG. 8 is a side cross-sectional view of a connector peg of a modified version 1.

An architectural structure 100 according to a modified version 1 is generally similar to the architectural structure 100 of the first embodiment. It includes the connector pegs 110 as in the case of the first embodiment. Each connector peg 110 of the modified version 1 is secured to the side wall 101 within a recess 102 formed in the side wall 101 (see, FIG. 8). The anchor 110A of the connector peg 110 is embedded in the bottom of the recess 102 by, for example, a method similar to the one described in the first embodiment. As a result, the connector peg 110 is not exposed to the outer surface of the side wall 101 that is a generally flat surface of the side wall 101 extending around the recess 102.

The recess 102 formed in the architectural structure 100 of the modified version 1 has, but not limited to, a plate-shaped opening cover 103 that can removably be attached to the opening of the recess 102. The opening cover 103 may removably be attached to the opening by applying a known method. With the opening cover 103, the connector peg 110 is not fully exposed to the outside. The outer surface of the opening cover 103 is, but not limited to, finished in the same manner as that of the side wall 101. For example, when the outer surface of the side wall 101 is tiled, the outer surface of the opening cover 103 is also tiled with a similar tile or tiles. As a result, the opening cover 103 would be compatible with the appearance of the side wall 101, reducing its influence on the appearance of the architectural structure 100.

While it is sufficient that the aforementioned design of the connector peg 110 fixed within the recess 102 with the opening cover 103 provided over the opening of the recess 102 is applied to at least one connector peg 110, the modified version 1 employs this design for all connector pegs 110.

A maintenance method for the architectural structure 100 according to the modified version 1 is basically identical to the one that is described in the first embodiment. One difference lies in the fact that the opening cover 103 should be removed from the opening of the recess 102 to expose the connector peg 110 outside before connecting the mast 200 and the connector peg 110 via the joint member 300.

The recess 102 has a shape and a size sufficient to provide a connection between the connector peg 110 and the catcher portion 302 of the joint member 300 in the recess 102. Since the recess 102 is designed with such a sufficient space, the connector peg 110 and the catcher portion 302 of the joint member 300 can be connected without any trouble within the recess 102.

Another difference of the modified version 1 from the first embodiment lies in the fact that the opening cover 103 may be re-attached to the opening of the recess 102 when the mast climber is dismantled after completion of maintenance operations. Since the connector peg 110 is completely sunk within the recess 102, it is easy to cover again, with the opening cover 103, the recess 102 having the connector peg 110 inside. The feature of the recess 102 having a shape and a size sufficient to provide a connection between the connector peg 110 and the catcher portion 302 of the joint member 300 in the recess 102 is also applied to the following description.

In the modified version 1, the connector peg 110 is fixed within the recess 102. However, rather than fixing the connector peg 110 within the recess 102, the connector peg 110 may be attached to the outer surface of the side wall 101 and a cover having a shape of, for example, a box or a dome with one side opened may be attached to the side wall 101 with the connector peg 110 positioned in the cover, thereby to prevent the connector peg 110 from being exposed. This cover also has a shape and a size sufficient to provide a connection between the connector peg 110 and the catcher portion 302 of the joint member 300 in the cover; i.e., has a sufficient space inside. The same applies to covers described below.

<Modified Version 2>

Next, a modified version 2 is described.

An architectural structure 100 of the modified version 2 is generally identical to the one in the modified version 1.

Figure 9:
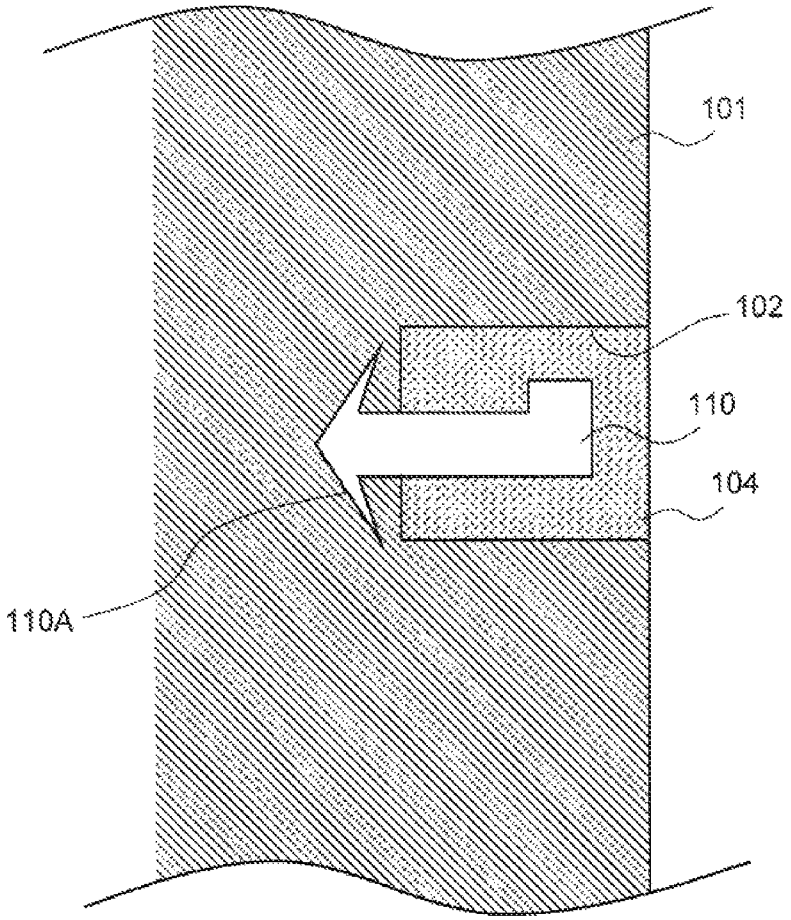
FIG. 9 is a side cross-sectional view of a connector peg of a modified version 2.

As shown in FIG. 9, the connector peg 110 is fixed within the recess 102.

However, in the modified version 2, the opening cover 103 over the opening of the recess 102 is not present.

The connector peg 110 fixed within the recess 102 is not exposed to the outside in a different manner from the one using the opening cover 103 in the modified version 1.

In the modified version 2, the recess 102 is filled with a filler material 104 to prevent the connector peg 110 from being exposed to the outside. The filler material 104 may be a clayey material such as clay, a mortar-like material such as mortar, or a resin such as urethane foam, urethane, and polystyrene foam.

A maintenance method for the architectural structure 100 according to the modified version 2 is basically identical to the one that is described in the modified version 1. One difference lies in the fact that, instead of removing the opening cover 103 from the opening of the recess 102, the filler material 104 in the recess 102 should be broken, or broken and removed, to expose the connector peg 110 outside before connecting the mast 200 and the connector peg 110 via the joint member 300. In other words, the connector peg 110 enclosed in the filler material 104 is exposed by breaking the latter.

It can be said that another difference of the modified version 2 from the modified version 1 lies in the fact that the recess 102 may be re-filled with the filler material 104 instead of re-attaching the opening cover 103 to the opening of the recess 102 when the mast climber is dismantled after the completion of maintenance operations. In the modified version 2, it becomes possible to make the appearance of the filler material 104 more compatible with that of the architectural structure 100 by producing better visual combinations of colors and textures of the filler material 104 and the exterior side wall 101.

In the modified version 2, the connector peg 110 is fixed within the recess 102. However, rather than fixing the connector peg 110 within the recess 102, the connector peg 110 attached to the outer surface of the side wall 101 may be covered with a material similar to the aforementioned filler material 104.

Figure 10:
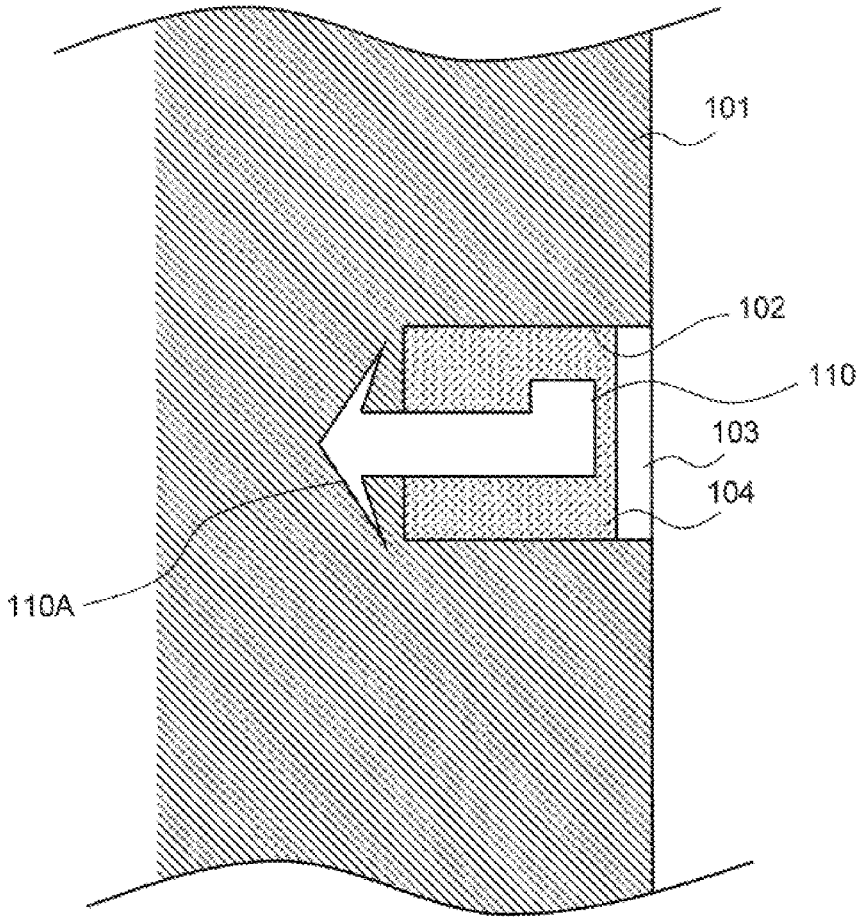
FIG. 10 is a side cross-sectional view of another connector peg of the modified version 2.

It is also possible to attach the opening cover 103 similar to the one in the modified version 1 may further be attached to the opening of the recess 102 in the modified version 2 (FIG. 10).

<Modified Version 3>

Next, a modified version 3 is described.

An architectural structure 100 of the modified version 3 is generally identical to those in the modified versions 1 and 2.

Figure 11:
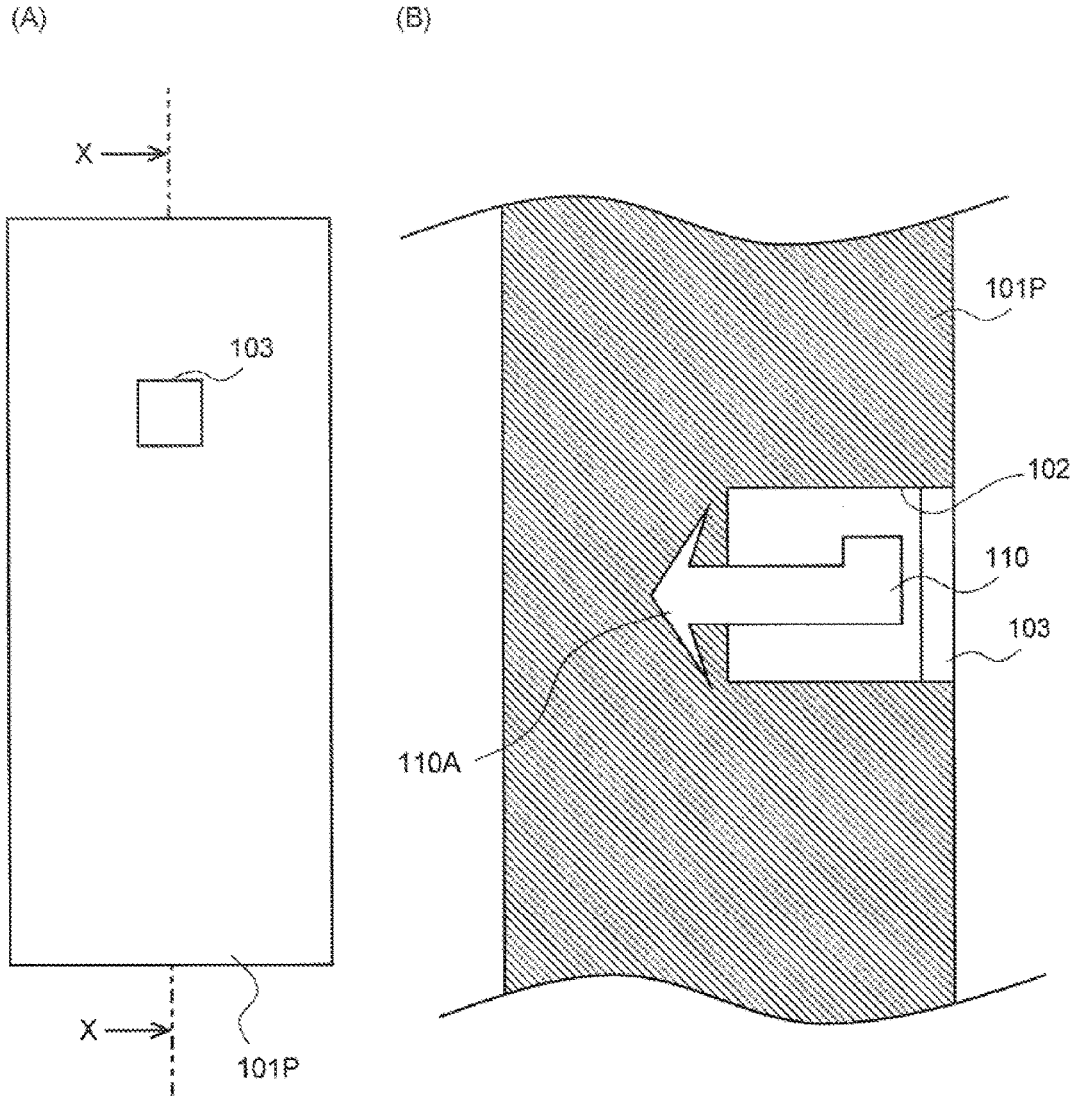
FIG. 11 is (A) a front view showing a structure of a panel of a modified version 3 and (B) an X-X cross-sectional view of an area near an opening cover provided in the panel.

A side wall 101 of the architectural structure 100 of the modified version 3 is made up of panels 101P (one of which is shown in FIG. 11) arranged in rows and columns. A recess 102, which is similar to the one described in the modified version 1, is formed in the panel 101P shown in FIG. 11. The connector peg 110 is fixed within the recess 102. An opening cover 103 is attached to the opening of the recess 102.

The architectural structure 100 of the modified version 3 using such panels 101P is similar in configuration, including the positions of the recesses 102 and the connector pegs 110, to the architectural structure in the modified version 1 except that each side wall 101 is made up of the panels 101P. Some panels 101P may have no recess 102 (accordingly, have no connector peg 110 nor opening cover 103). Alternatively, a panel or panels 101P may have two or more recesses 102 (accordingly, have corresponding connector pegs 110 and opening covers 103). Furthermore, different panels 101P may have the recesses 102 (and the connector pegs 110 and opening covers 103) in their front faces at different positions.

Other features described in the modified versions 1 and 2 may be applied to the panel 101P of the modified version 3.

<Modified Version 4>

Next, a modified version 4 is described.

An architectural structure 100 of the modified version 4 is generally identical to the one in the first embodiment. The difference of the architectural structure 100 of the modified version 4 from the architectural structure 100 of the first embodiment lies in the configuration of a connector peg 110.

Figure 12:
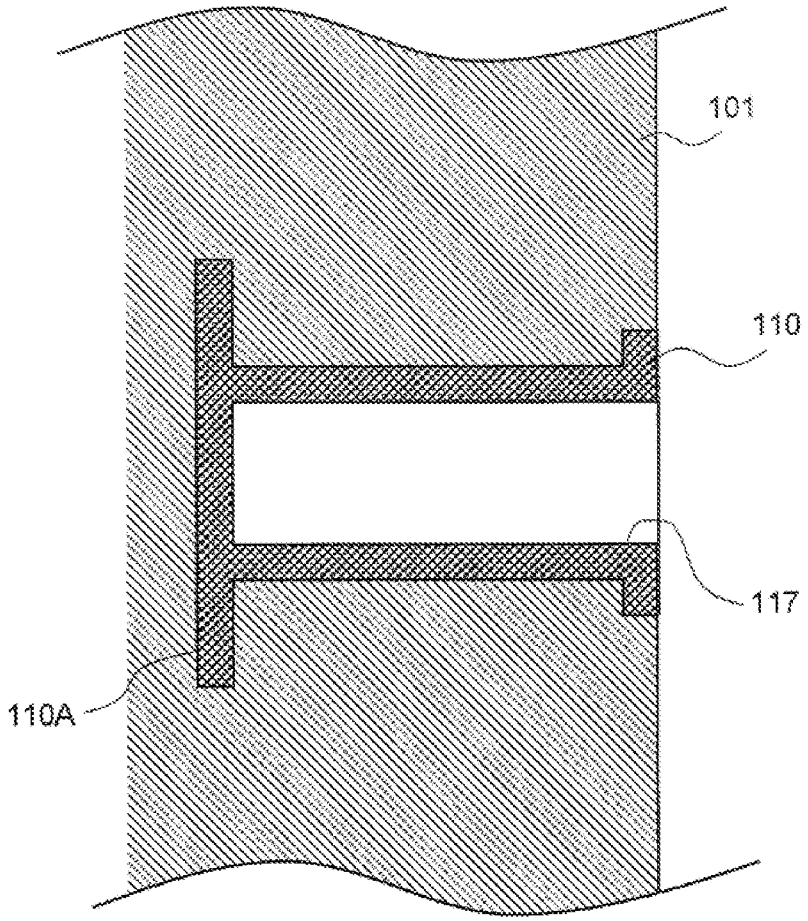
FIG. 12 is a side cross-sectional view of a connector peg of a modified version 4.

This connector peg 110 is a nut (FIG. 12). The connector peg 110 which is a nut has a threaded hole 117 on the inside. An opening of the threaded hole 117 at one end surrounded by a flange is exposed to the outside, from the side wall 101 of the architectural structure 100. For example, when the side wall 101 is made of concrete, the connector peg 110 which is a nut is embedded in the side wall 101 by positioning the connector peg 110 at a position shown in FIG. 12 and pouring the concrete. An anchor 110A formed as a wide flange is provided at the rear end of the connector peg 110. With the anchor 110A, the connector peg 110A is less likely to be fallen off the side wall 101.

While not illustrated, a joint member 300 connected to the connector peg 110 of the modified version 4 includes a bolt at one end thereof. The bolt is capable of being screwed with the threaded hole 117. The joint member 300 is securely fixed to the connector peg 110 by screwing the bolt with the threaded hole 117.

Figure 13:
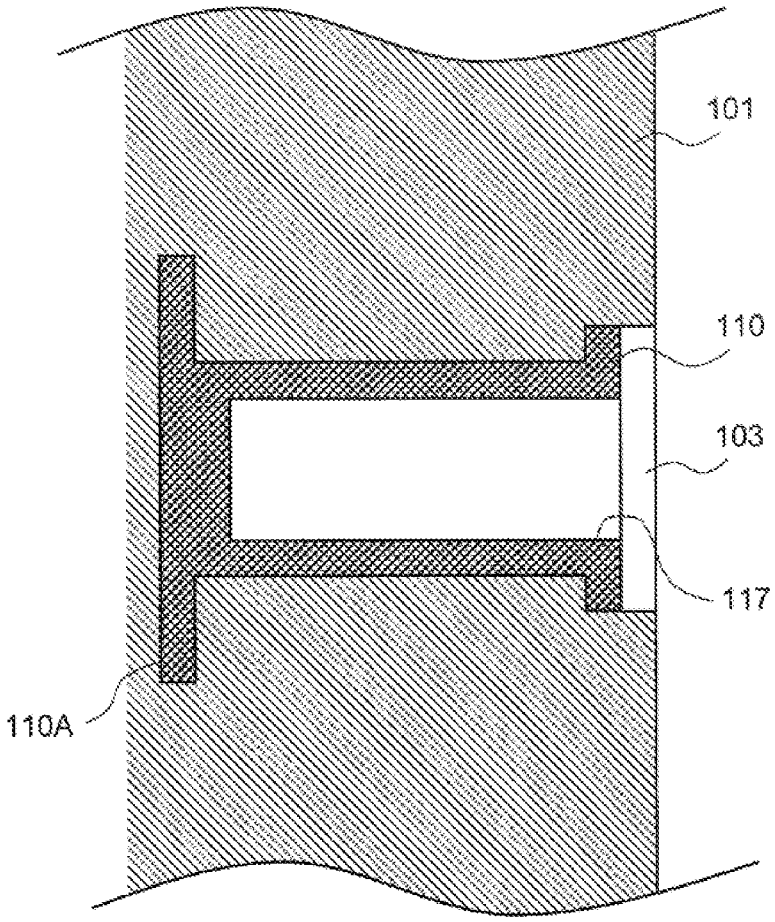
FIG. 13 is a side cross-sectional view of another connector peg of a modified version 4.

The connector peg 110 of the modified version 4 can be said to be embedded in a recess formed in the side wall 101 in a certain sense. Such connector peg 110 may be concealed with an opening cover 103 (FIG. 13) as in the case of the modified versions 1 and 3. The opening cover 103 can be attached to and removed from the side wall 101 as in the case of the modified versions 1 and 3.

A maintenance method for the architectural structure 100 according to the modified version 4 is basically identical to the one that is described in the first embodiment.

<Modified Version 5>

Next, a modified version 5 is described.

An architectural structure 100 of the modified version 5 is generally identical to the one in the first embodiment. The difference of the architectural structure 100 of the modified version 5 from the architectural structure 100 of the first embodiment lies in the configuration of a fixing member 130.

Figure 14:
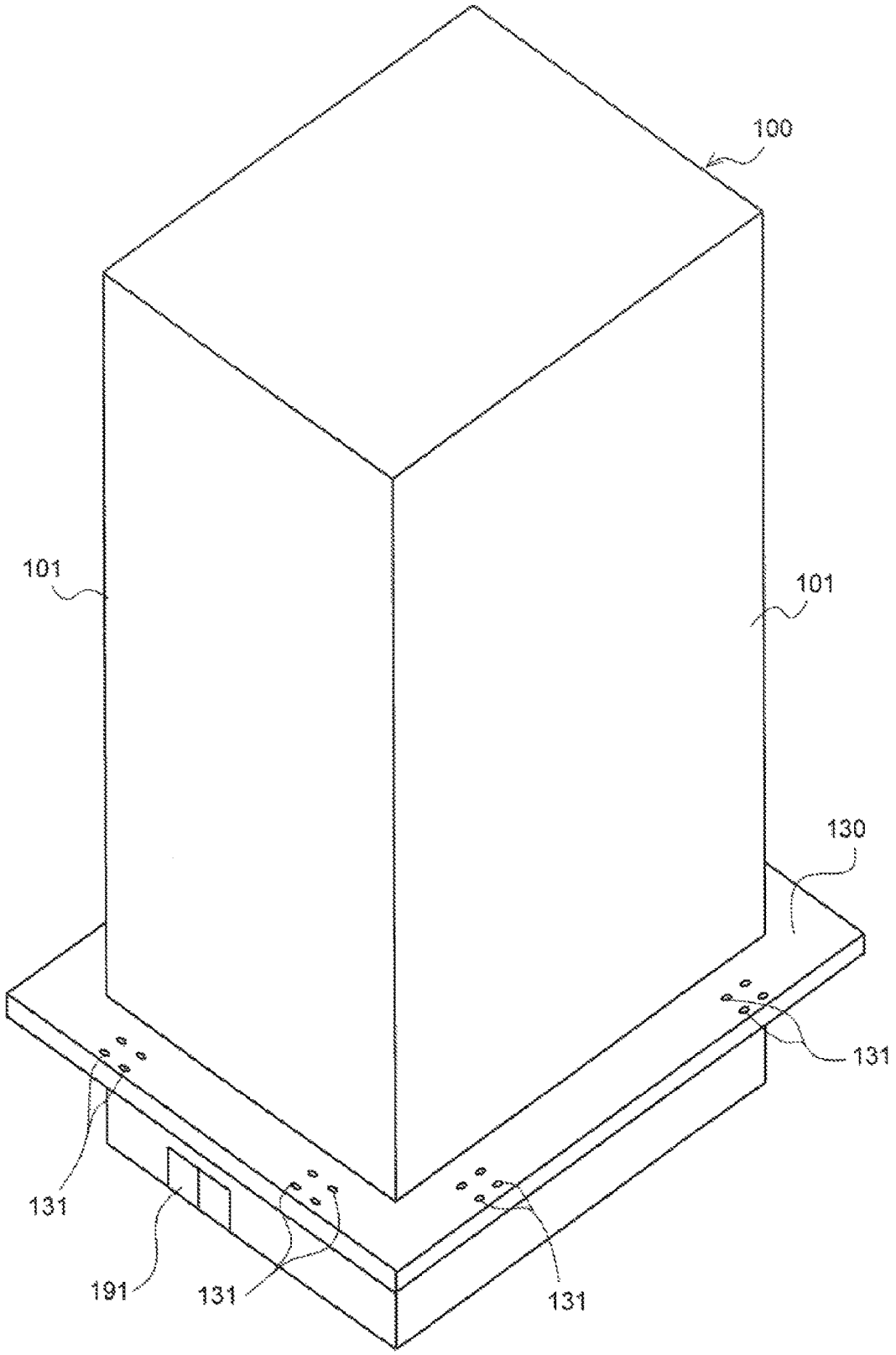
FIG. 14 is a perspective view schematically showing an entire architectural structure according to a modified version 5.

The fixing member 130 of the architectural structure 100 of the first embodiment has a rectangular plate-like shape, and each side wall 101 is fitted with two fixing members 130. In contrast, the fixing member 130 of the modified version 5 is like a flat rectangular ring surrounding the architectural structure 100 (FIG. 14).

In the modified version, eight masts 200 are erected on one fixing member 130. Thirty-two holes 131 in total are formed in the fixing member 130 to allow it. The holes 131 are located at the positions identical to those of the holes 131 formed in the fixing members 130 in the first embodiment, but it is not necessarily so.

A maintenance method for the architectural structure 100 according to the modified version 5 is identical to the one that is described in the first embodiment.

As can be seen from the comparison between the first embodiment and the modified version 5, the number of the fixing members 130 provided on the architectural structure 100 may be one or more. The number of the masts secured to one fixing member 130 may be one or more.

<Modified Version 6>

Next, a modified version 6 is described.

An architectural structure 100 of the modified version 6 is generally identical to the one in the first embodiment. The difference of the architectural structure 100 of the modified version 6 from the architectural structure 100 of the first embodiment lies in the configuration of the fixing member 130. In the modified version 6, the fixture stud(s) 132 is/are secured to the fixing member 130 before the mast 200 is erected (e.g., since the construction of the architectural structure 100 was completed).

Figure 19:
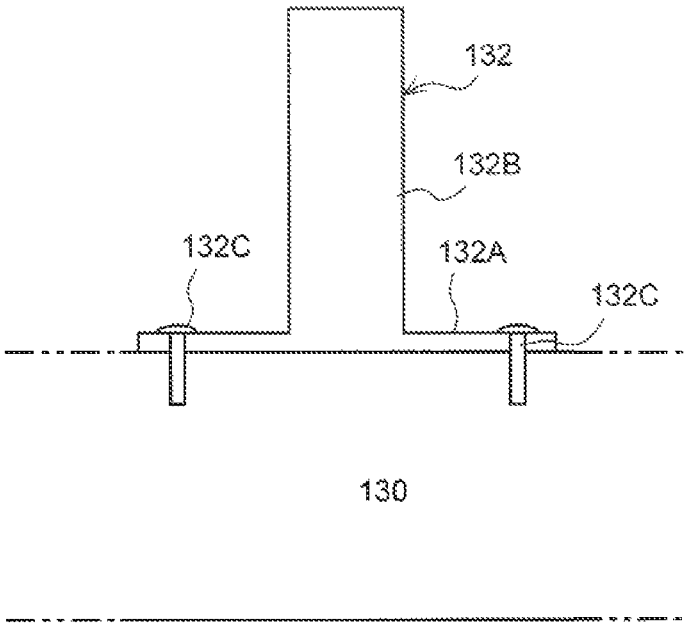
FIG. 19 is a front view showing an example of a connector peg of a modified version 6.
Figure 19:
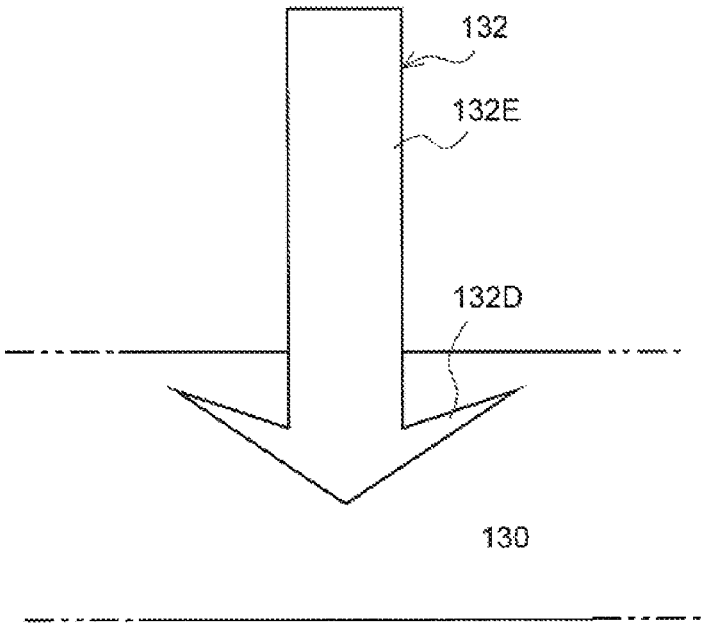

As an example, the fixture stud 132 is secured to the fixing member 130 in a manner shown in FIG. 19.

The fixture stud 132 shown in FIG. 19(A) has a plate-shaped fixture base 132A, and a bolt section 132B with a threaded outer surface. The fixture base 132A has holes, and the fixture base 132A is secured to the fixing member 130 by screws 132C passing through the holes.

The fixture stud 132 shown in FIG. 19(B) has an anchor 132D that is embedded in the fixing member 130 to prevent the fixture stud 132 from escaping and a bolt section 132E with a threaded outer surface. The anchor 132D has a shape like an open umbrella. The fixture stud 132 is secured to the fixing member 130 at the time when the fixing member 130 is formed by embedding the anchor 132D in the concrete when the concrete is being poured to form, for example, the fixing member made of concrete.

The maintenance method for the architectural structure 100 of the modified version 6 follows the steps after the fixture stud 132 is secured to the holes 131 of the fixing member 130 in the maintenance method for the architectural structure 100 of the first embodiment.

Second Embodiment

An architectural structure 100 according to a second embodiment is a so-called non-building structure, more specifically, a chimney. Some chimneys such as those of incinerators are high-rise with a height of more than 20 m.

Figure 15:
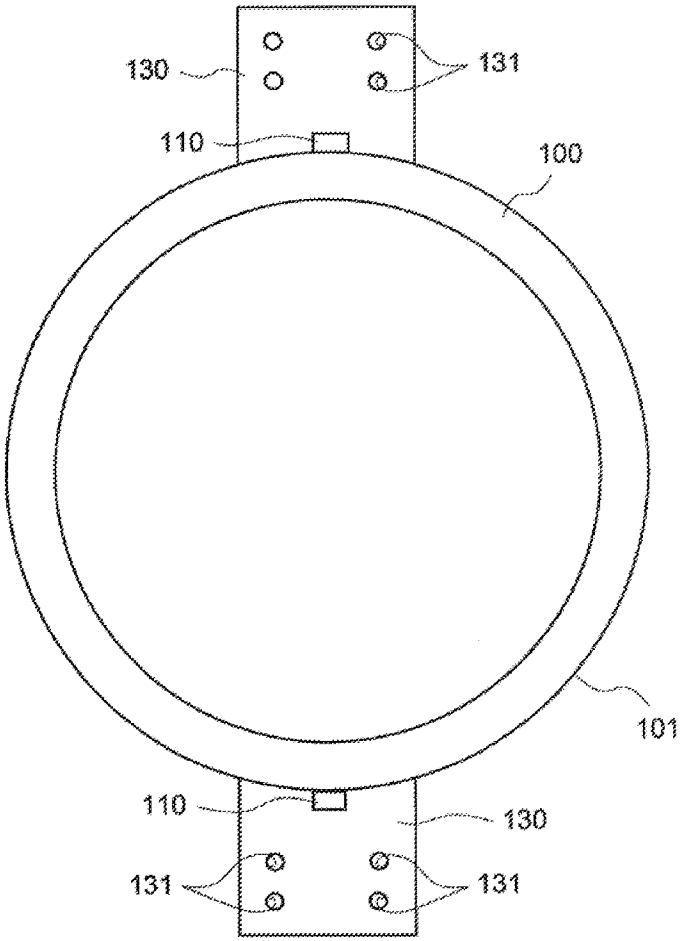
FIG. 15 is a plan view schematically showing an architectural structure according to a second embodiment of the present invention.

A side wall 101 which is an arc-shaped surface of the architectural structure 100 according to the second embodiment has a fixing member 130 as in the first embodiment, as shown in the plan view in FIG. 15. The second embodiment has two fixing members 130 which are opposed to each other relative to the center of the chimney. The fixing member 130 of the second embodiment is positioned above ground level, as in the case of the first embodiment. In addition, the side wall 101 of the architectural structure 100 of the second embodiment has is also fitted with connector pegs. The connector pegs 110 of the second embodiment are aligned on a vertical line that is directly opposite to a line extending vertically from the point where holes 131 in the fixing member 130 are present.

The maintenance method for the architectural structure 100 according to the second embodiment is similar to the one described in the case of the first embodiment, and maintenance operations are performed by a worker on a climbing work platform 210 fixed to a mast 200.

The climbing work platform 210 of the second embodiment is made up of a plurality of platform segments 211. Overlap between the adjacent platform segments 211 can be adjusted and an angle between the adjacent platform segments 211 can be varied. Accordingly, the climbing work platform 210 can be curved to the curvature of the side wall 101 of the architectural structure 100 which is a chimney. Mast climbers having such a climbing work platform with a plurality of platform segments that can be extend and bent have already been used practically.

Figure 16:
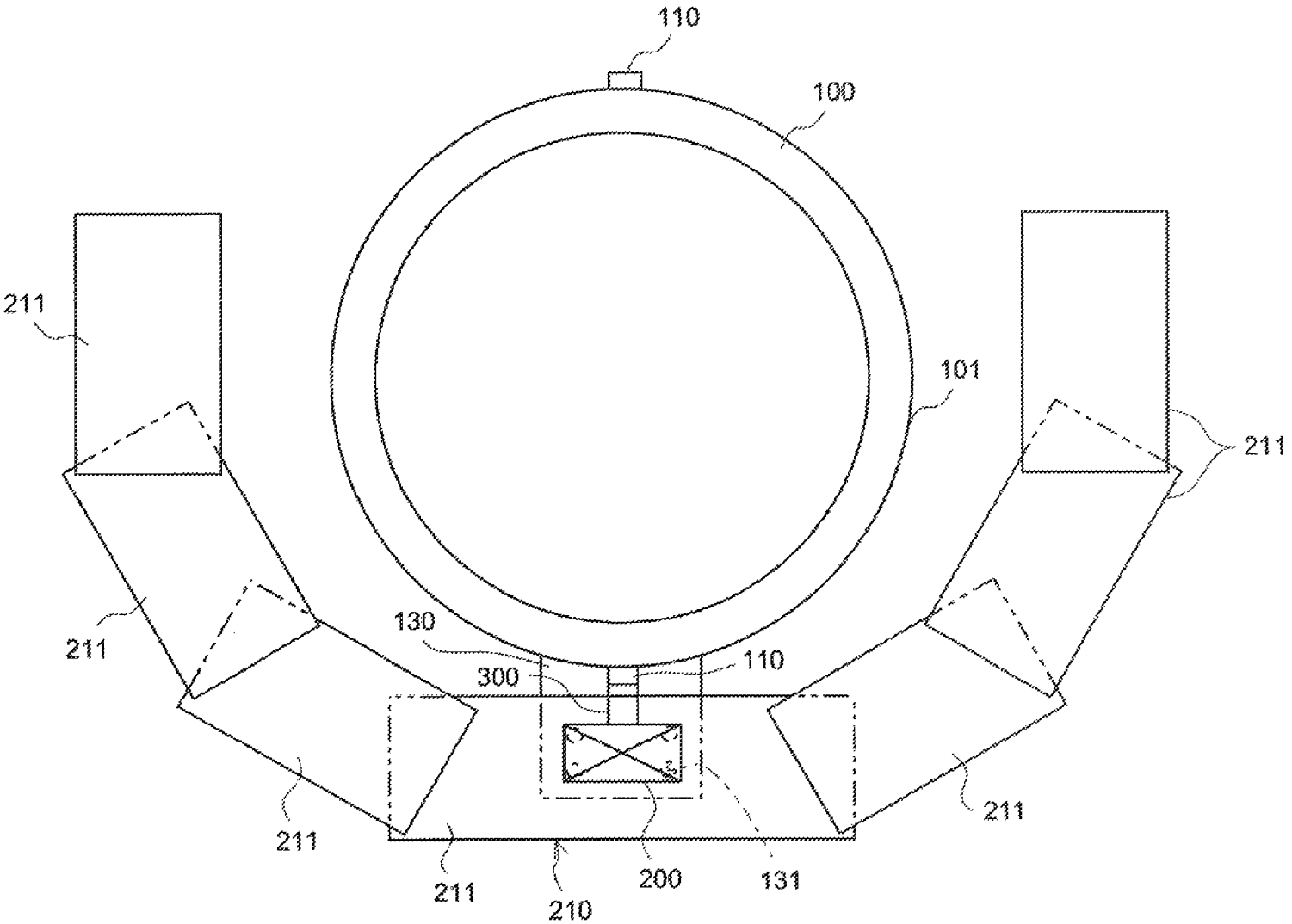
FIG. 16 is a plan view schematically showing a state where an architectural structure according to a second embodiment of the present invention is under maintenance.

In the case shown in FIG. 16, the climbing work platform 210 extends generally right halfway around the side wall 101. When the mast 200 is erected on the fixing member 130 on the left side of FIG. 16, maintenance can be conducted on the left half of the side wall 101.

The fixture stud 132 can be attached to the fixing member 130 on the architectural structure 100 from the beginning, as in the case of the first embodiment.

Third Embodiment

Next, a third embodiment is described.

Figure 17:
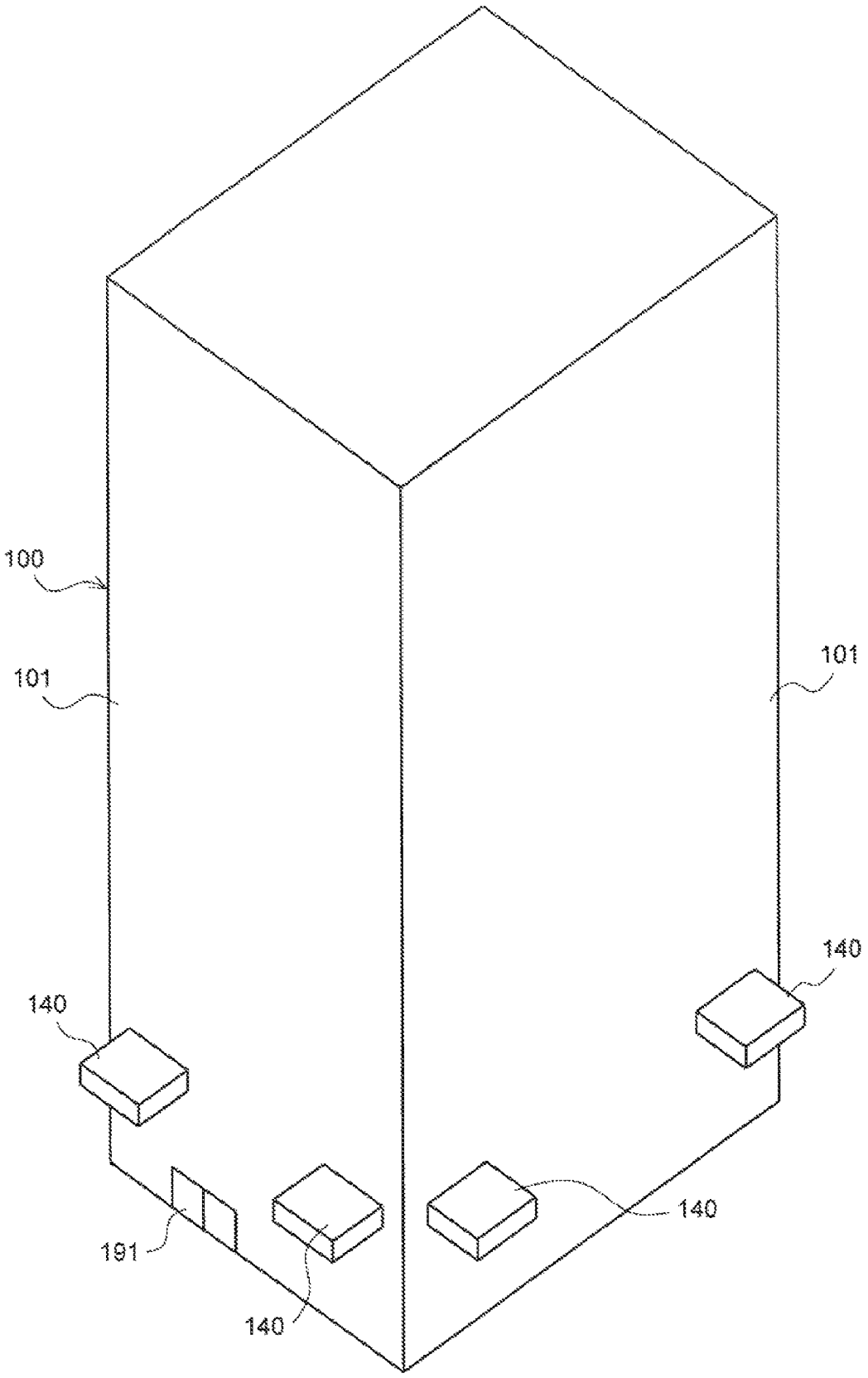
FIG. 17 is a perspective view schematically showing an architectural structure according to a third embodiment of the present invention.
Figure 18:
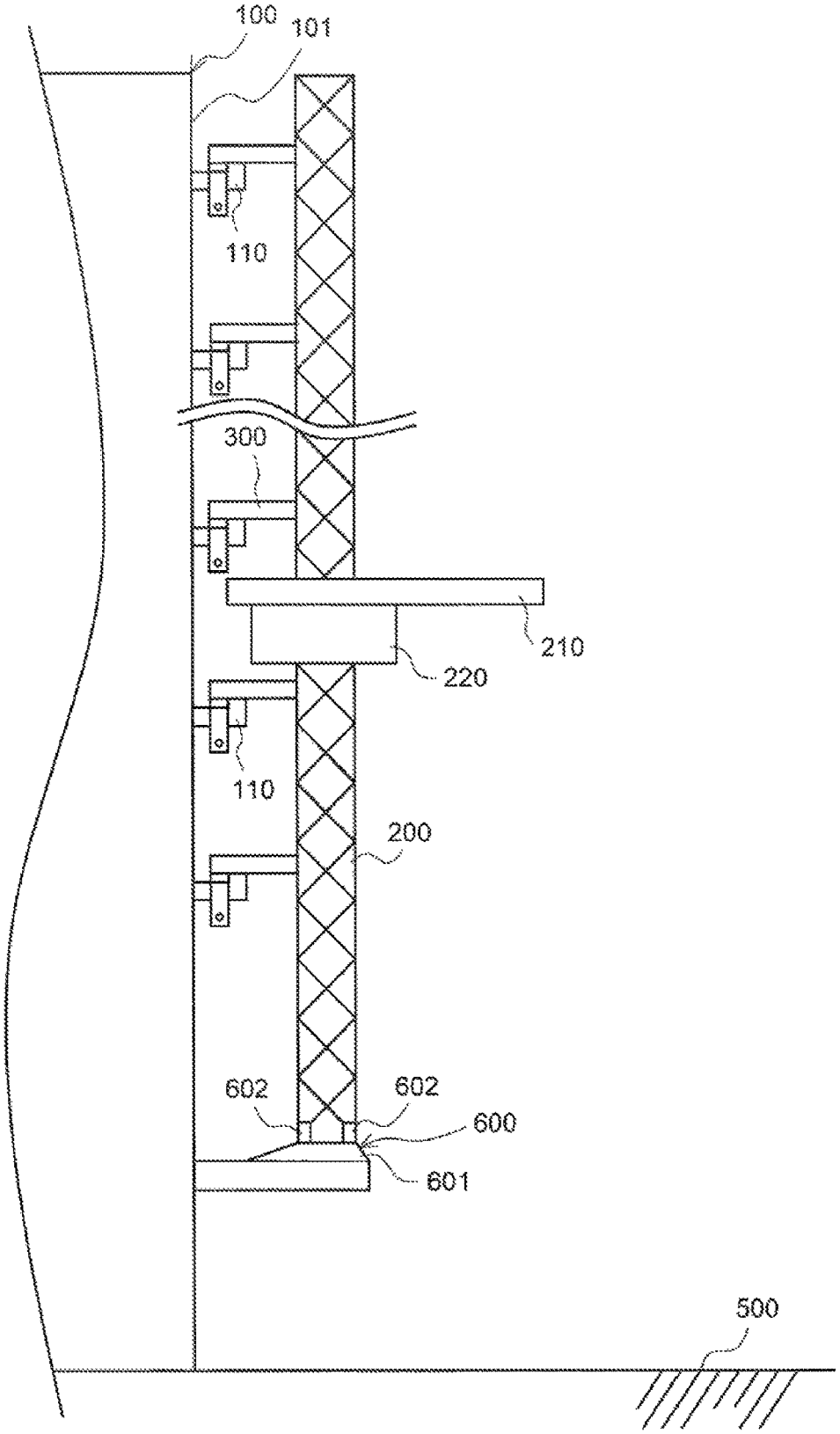
FIG. 18 is a side view schematically showing a state where the architectural structure shown in FIG. 17 is under maintenance.

An architectural structure 100 of the third embodiment is generally identical to the one in the first embodiment. The difference of the architectural structure 100 of the third embodiment from the architectural structure 100 of the first embodiment lies in the fact that the architectural structure 100 of the third embodiment includes no fixing members 130 located on the architectural structure 100 of the first embodiment; instead, it includes a pedestal member 140 (FIG. 17).

Each side wall 101 of the architectural structure 100 of the first embodiment is fitted with two fixing members 130 each having a rectangular plate-like shape. The pedestal member 140 is basically identical in structure to the fixing member 130. The difference of the pedestal member 140 from the fixing member 130 lies in the fact that the pedestal member 140 does not have the hole(s) 131 formed in fixing member 130. As described below, the pedestal member 140 is configured to receive a chassis placed thereon which is connected to the lower end of the mast 200 to support it.

The architectural structure 100 includes connector pegs 110 which are similar to those described in the first embodiment.

A maintenance method for the architectural structure 100 according to the third embodiment is slightly different from that described in the first embodiment.

To conduct maintenance of the architectural structure 100 of the third embodiment, a chassis 600 is placed on the pedestal member 140. The chassis 600 can be a conventional chassis. The chassis 600 has a base 601 that is of sufficient size, shape, and weight to stably secure the mast 200 when its lower end is securely fixed to the chassis 600, and fixture studs 602 for fixing the lower end of the mast 200. The chassis 600 is placed on the pedestal member 140 in such a manner that the mast 200 with its lower end secured to the fixture studs 602 of the chassis 600 is located at the preferable position to provide maintenance of the architectural structure 100 using the mast climber.

After the chassis 600 is placed on the pedestal member 140, the lowest mast module of the mast 200 is secured to the fixture studs 602 of the chassis 600, in a manner similar to the one used to secure the lowest mast module of the mast 200 to the fixture studs 132 in the first embodiment. The subsequent steps for the maintenance of the architectural structure 100 of the third embodiment are similar to those described in the first embodiment.

The connector pegs 110 of the architectural structure 100 of this embodiment are provided on the side wall 101 on a vertical line that is directly opposite to a line extending vertically from the points where the fixture studs 602 are present after the chassis 600 is placed at the intended position on the pedestal member 140. The number of the connector pegs 110 is, for example, two or more. The upper portion of the mast 200 is appropriately secured to the connector pegs 110.

What is claimed is:

1. A high-rise architectural structure that accommodates temporary attachment of a mast structure above ground level at positions suitable to facilitate maintenance of the high-rise architectural structure, the high-rise architectural structure comprising finished sidewalls that separate a building interior from a building exterior, at least one of said finished side walls extending vertically from a lower end at ground level to an upper end, the architectural structure comprising:

at least one fixing member that extends outward from the at least one finished side wall of the architectural structure at a level at least two meters above the lower end of the side wall of the architectural structure, the fixing member having an upper surface and a lower surface;

structure provided on the upper surface of the at least one fixing member to permit receipt of a plurality of fixture studs adapted for attachment to a lower end of the mast structure such that the mast structure is positioned above ground level, the at least one fixing member being configured to support fixture studs required to attach mast structures at positions to provide maintenance of the architectural structure; and further comprising a plurality of connector pegs provided on the at least one finished side wall of the high-rise architectural structure, each of the connector pegs being permanently secured to the at least one finished side wall of the high-rise architectural structure, said peg including structure to facilitate temporary connection to the mast structure, the connector pegs each being vertically aligned with the fixture stud so as to facilitate attachment with the mast such that the lower end of the mast is attached to the fixture stud and the mast is connected to said connector pegs along its length such that the mast is supported stably by the fixture studs and the connector pegs.

2. The architectural structure according to claim 1, wherein the fixture studs are secured to the at least one fixing member.

3. The architectural structure according to claim 1, wherein the at least one fixing member has a flat shape that is rectangular when viewed from above.

4. The architectural structure according to claim 1, wherein the number of the at least one fixing members is two or more.

5. The architectural structure according to claim 1, wherein a single fixing member is configured to be fitted with the fixture studs to connect two or more masts to the fitting member.

6. The architectural structure according to claim 1, wherein a proximal end of each connector peg is integrally embedded in the side wall.

7. The architectural structure according to claim 1, wherein an anchor is provided, on the proximal end of the connector pegs to secure the connector pegs to the side wall.

8. The architectural structure according to claim 1, wherein recessed openings are provided in the side wall and the connector pegs are provided in recessed openings in the side wall; and wherein a removable opening cover is provided to cover the recessed openings so that that connector pegs are completely enclosed by the recessed openings and cover.

9. A high-rise architectural structure that accommodates temporary attachment of a mast structure above ground level at positions suitable to facilitate maintenance of the high-rise architectural structure, the high-rise architectural structure comprising at least one finished side wall that separates a building interior from a building exterior and extends vertically from a lower end at ground level to an upper end, the architectural structure comprising:

at least one pedestal member for supporting at least one chassis at a level at least two meters above the lower end of the finished side wall of the architectural structure, the chassis having at one fixture stud that permits connection to a lower end of the mast structure, and the chassis further comprising a base to which the fixture stud can be attached so that the lower end of the mast structure mast is positioned at least two meters above ground level, further comprising a plurality of connector pegs provided on the at least one finished side wall of the high-rise architectural structure, each of the connector pegs being permanently secured to the at least on finished side wall of the high-rise architectural structure, said peg including structure to facilitate temporary connection to the mast structure, the connector pegs being aligned so as to facilitate attachment with a mast such that the mast is connected to connector pegs along its length; and the base being configured to support the mast, the at least one pedestal member being configured to support the chassis thereon at positions to provide maintenance of the architectural structure.

10. A maintenance method for a high-rise architectural structure that includes one or more fixing members extending outward from a finished side wall of the architectural structure at a level at least two meters above the lower end of the side wall of the architectural structure and a plurality of connector pegs provided on the finished side wall of the high-rise architectural structure, each of the connector pegs being permanently secured to the finished side wall of the high-rise architectural structure where each fixing member has an upper surface and a lower surface and structure is provided on the upper surface of the at least one fixing member to permit receipt of a plurality of fixture studs adapted for attachment to a lower end of the mast structure such that the mast structure is positioned above ground level, the at least one fixing member being configured to support fixture studs required to accommodate temporary attachment of a mast structure above ground level at positions suitable to facilitate maintenance of the high-rise architectural structure the connector pegs including structure to facilitate temporary connection to the mast structure, the connector pegs being aligned so as to facilitate attachment with a mast such that the mast is connected to connector pegs along its length; the maintenance method comprising the steps of:

attaching the fixture stud to the at least one fixing member at a position where the mast structure is to be erected;

setting the at least one mast along the finished side wall of the architectural structure by connecting the lower end of the at least one mast to the attached fixture stud;

attaching the connector pegs to the mast such that the mast is connected to connector pegs along its length;

attaching a platform to the erected at least one mast, the platform being capable of moving up and down the at least one mast to which it is attached; and moving up and down the platform along the at least one mast while a worker on the platform is performing maintenance of the architectural structure.

11. A maintenance method for a high-rise architectural structure that includes at least one finished side wall extending vertically from a lower end at ground level to an upper end and structure that accommodates temporary attachment of a mast structure above ground level at positions suitable to facilitate maintenance of the high-rise architectural structure the architectural structure including at least one pedestal member for supporting at least one chassis at a level at least two meters above the lower end of the finished side wall of the architectural structure and a plurality of connector pegs provided on the finished side wall of the high-rise architectural structure, each of the connector pegs being permanently secured to the finished side wall of the high-rise architectural structure the chassis having at one fixture stud that permits connection to a lower end of the mast structure, and the chassis further comprising a base to which the fixture stud can be attached so that the lower end of the mast structure mast is positioned at least two meters above ground level, the base being configured to support the at least one mast, the at least one pedestal member being configured to support the chassis thereon at positions to provide maintenance of the architectural structure, the connector pegs including structure to facilitate temporary connection to the mast structure, the connector pegs being aligned so as to facilitate attachment with a mast such that the mast is connected to connector pegs along its length; and the method comprising the steps of:

placing the chassis on the pedestal member at a position where the mast structure is to be erected;

setting the at least one mast along the finished side wall of the architectural structure by connecting the lower end of the mast structure to the fixture studs of the placed chassis;

attaching a platform to the erected mast structure, the platform being capable of moving up and down the at least one mast to which it is attached;

attaching the connector pegs to the mast such that the mast is connected to connector pegs along its length; and moving up and down the platform along the mast structure while a worker on the platform is performing maintenance of the architectural structure.

* * * * *